US006758556B2

(12) United States Patent
Ishizawa et al.

(10) Patent No.: US 6,758,556 B2
(45) Date of Patent: Jul. 6, 2004

(54) INK CARTRIDGE, AND INK-JET RECORDING APPARATUS USING THE SAME

(75) Inventors: Taku Ishizawa, Nagano (JP); Toshio Kumagai, Nagano (JP); Masanori Kamijyo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/092,623

(22) Filed: Mar. 8, 2002

(65) Prior Publication Data

US 2002/0089576 A1 Jul. 11, 2002

Related U.S. Application Data

(62) Division of application No. 09/765,411, filed on Jan. 22, 2001.

(30) Foreign Application Priority Data

| | | |
|---|---|---|
| Jan. 21, 2000 | (JP) | P.2000-012461 |
| Jan. 21, 2000 | (JP) | P.2000-012462 |
| Jan. 31, 2000 | (JP) | P.2000-021020 |
| Feb. 1, 2000 | (JP) | P.2000-024419 |
| Jun. 21, 2000 | (JP) | P.2000-186050 |
| Jul. 4, 2000 | (JP) | P.2000-201983 |

(51) Int. Cl.[7] ..... M41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 4,935,751 A | * | 6/1990 | Hamlin | 347/86 |
| 5,505,339 A | | 4/1996 | Cowger et al. | 222/105 |
| 5,541,632 A | | 7/1996 | Khodapanah et al. | 347/87 |
| 5,793,387 A | | 8/1998 | Hunt | 347/7 |
| 5,852,459 A | | 12/1998 | Pawlowski, Jr. et al. | 347/86 |
| 5,896,151 A | * | 4/1999 | Miyazawa et al. | 347/86 |
| 5,912,688 A | | 6/1999 | Gragg | 347/86 |
| 6,010,210 A | * | 1/2000 | Wilson et al. | 347/85 |
| 6,012,807 A | | 1/2000 | Olsen et al. | 347/85 |
| 6,030,074 A | * | 2/2000 | Barinaga | 347/85 |
| 6,106,112 A | * | 8/2000 | Okubo et al. | 347/86 |

FOREIGN PATENT DOCUMENTS

| | | | | |
|---|---|---|---|---|
| EP | 0 604 127 A1 | | 6/1994 | |
| EP | 0 778 145 A1 | | 6/1997 | |
| EP | 0 827 836 A1 | | 3/1998 | |
| EP | 0 894 630 A2 | | 2/1999 | |
| EP | 0899112 A2 | * | 3/1999 | B41J/2/175 |
| EP | 0 927 638 A2 | | 7/1999 | |
| EP | 0 928 694 A1 | | 7/1999 | |
| EP | 9 947 328 A2 | | 10/1999 | |
| EP | 0 965 451 A2 | | 12/1999 | |
| JP | 8-230204 | | 9/1996 | |
| JP | 10-138506 A | | 5/1998 | |

OTHER PUBLICATIONS

Japanese Abstract No. 63145038, dated Jun. 17, 1988.
Japanese Abstract No. 10138506, dated May 26, 1998.

* cited by examiner

*Primary Examiner*—Anh T. N. Vo
(74) *Attorney, Agent, or Firm*—Sughrue Mion, PLLC

(57) ABSTRACT

There is provided an ink cartridge which is formed from an ink-filled ink pack and a hermetic outer shell case for housing the ink pack and which supplies ink to a recording head by means of application of air pressure to a space between the outer shell case and the ink pack. The outer shell case is formed by coupling an upper case and a lower case together. The ink-filled ink pack is housed in the lower case, and the upper case is laid on the lower case from above. The upper and lower cases are hermetically sealed by vibratory welding or heat welding, thus constituting the ink cartridge.

59 Claims, 29 Drawing Sheets

INK CARTRIDGE, AND INK-JET RECORDING APPARATUS USING THE SAME

This is a divisional of application Ser. No. 09/765,411 filed Jan. 22, 2001; the disclosure of which is incorporated herein by reference.

BACKGROUND OF THE INVENTION

1. Field of the Invention

The present invention relates to an ink cartridge which is to be used with an ink-jet recording apparatus and is constructed so as to feed ink to a recording head. The present invention also relates to an ink-jet recording apparatus using the ink cartridge.

2. Description of the Related Art

An ink-jet recording apparatus produces comparatively low noise during printing operation and can form small dots at high density. Hence, the ink-jet recording apparatus has recently been used in a number of printing applications, including color printing.

Such an ink-jet recording apparatus is usually equipped with an ink-jet recording head which is mounted on a carriage and moved in the widthwise direction of recording paper, and paper feed means for moving the recording paper in the direction orthogonal to the traveling direction of the recording head. On the basis of print data, ink droplets are ejected from the recording head, thus recording the data on the recording paper.

The recording head is mounted on the carriage, and is capable of ejecting ink droplets of, for example, black, yellow, cyan, and magenta. Accordingly, the ink-jet recording apparatus enables full-color printing by changing the proportions of ink types, as well as effecting text printing with black ink.

Incidentally, in order to effect a comparatively-high volume of printing, a recording apparatus of this type supplied for, for example, an office or business purpose, requires use of high-volume ink cartridges. To this end, there has been provided a recording apparatus, in which ink cartridges are fitted to a cartridge holder provided, for example, to an apparatus main body.

In the recording apparatus, sub-tanks are disposed on the carriage having the recording head, and the respective sub-tanks are replenished with ink from corresponding ink cartridges by way of ink supply tubes. The sub-tanks, in turn, supply ink to the recording head.

Recently, growing demand exists for a large-size recording apparatus capable of effecting printing on larger-size paper, in which a carriage travels a longer scan distance. In order to improve throughput of such a recording apparatus, a larger number of nozzles are provided in a recording head.

Further, demand exists for a recording apparatus which sequentially supplies ink to the respective sub-tanks mounted on the carriage from corresponding ink cartridges while performing printing operation, in order to improve throughput, and which stably supplies ink from the respective sub-tanks to the recording head.

In such a recording apparatus, since the carriage travels over a longer scan distance, the lengths of respective ink supply tubes inevitably increase. Further, as mentioned above, a larger number of nozzles are provided in the recording head. Hence, such a recording apparatus encounters a technical problem of deficient ink supply to the sub-tanks because the recording head consumes a large quantity of ink, and an increase in the dynamic pressure (i.e., pressure loss) of ink is likely to occur within each of the ink supply tubes interconnecting the ink cartridges and the sub-tanks.

As one measure to prevent this technical problem, there may be employed, for example, a construction in which air pressure is applied to the ink cartridges to forcibly inducing ink flows from the ink cartridges to the sub-tanks under air pressure. This construction makes it possible to supply a sufficient amount of ink to the sub-tanks.

FIG. 36 is a cross-sectional view showing an example construction of a related-art ink cartridge utilized for such an ink-jet recording apparatus. In FIG. 36, reference numeral 81 designates a case defining the outer shell of an ink cartridge. The case 81 is integrally formed, into a shape of a bottle having a relatively large opening, from synthetic resin material by means of blow molding (hollow molding).

A columnar cap member 84 is fitted into an opening section 82 by way of an O-ring 83. By means of the cap member 84 and the O-ring 83, the inside of the case 81 is sealed, thus constituting a pressure chamber 85 within the case 81.

An ink outlet section 86 employing a ball valve is formed in the center of the columnar cap member 84. Ink can be led out from an ink pack 87—which is housed in the case 81 and formed from ink-filled flexible material—to the outside via the ink outlet section 86.

An air inlet port 89 is formed in a portion of the cap member 84. A rubber plug 88 is fitted on the air inlet port 89. A through hole 88*a* is formed in the center of the rubber plug 88. When the ink cartridge is not attached to an ink-jet recording apparatus, the through hole 88*a* is closed.

When the ink cartridge is attached to the recording apparatus, an unillustrated hollow needle provided on the recording apparatus penetrates through the through hole 88*a* of the rubber plug 88, and pressurized air can enter the pressure chamber 85 by way of the hollow needle.

Consequently, the pressurized air is introduced into the pressure chamber 85 by way of the hollow needle. Upon receipt of pressure, the ink contained in the ink pack 87 is led to the outside by way of the ink outlet section 86.

The above ink cartridge of related-art construction involves several problems to be solved, as described below.

A first problem is as follows: In the ink cartridge of the related-art construction mentioned above, the case forming the outer shell is integrally formed by blow molding, and consequently, as can be seen from the exemplified construction shown in FIG. 36, the ink pack 87 is integrally attached to the columnar cap member 84 formed with the ink replenishing valve 86 and the air introducing valve 88.

The cap member 84 is pressure-fitted to the opening section 82 using the O-ring 83 so that the ink pack 87, which has not been filled with ink, is inserted into the case 81. Subsequently, ink is injected into the ink pack 87 from the exterior via the ink replenishing valve 86 to thereby complete a product, i.e. the ink cartridge.

Since the case defining the outer shell of the ink cartridge of related-art construction is integrally formed by blow molding, difficulty is often encountered in assembling an ink pack, which has already filled with ink, into the case. That is, the ink pack must be filled with ink in a subsequent process.

Further, predetermined pressure is imposed on the inside of the case during the recording operation of the recording apparatus. There must be employed a countermeasure for preventing deformation of the case, which would otherwise be caused when the case receives the pressure. For this reason, in order to ensure the strength of the case, adoption of a simple construction, such as a cylindrical shape like a bottle having a relatively large opening section as shown in FIG. 36, is preferable.

However, such an outer shell yields a problem of an increase in the occupation volume of the case, resulting in difficulty in designing the layout of a recording apparatus of this type, which requires parallel arrangement of color ink cartridges.

Another conceivable measure for ensuring the strength of the case is to increase the thickness of the case. However, a large quantity of synthetic resin material is consumed for forming a case, thus posing difficulty in contributing to conservation of resources.

In contrast, another conceivable measure for reducing the quantity of synthetic resin material consumed is to integrally form reinforcement ribs on a part of the case. However, as mentioned above, when blow molding is employed for forming a case, forming reinforcement ribs in the interior of the case is usually difficult.

A second problem is that, in a case where ink cartridges of related-art construction attached to a recording apparatus are removed from the recording apparatus after having performed ink supply operation, the through hole 88*a* formed in the rubber plug 88 is closed immediately due to elasticity of rubber, thereby leaving pressurized air within the pressure chamber 85.

The pressurized air remaining in the pressure chamber 85 continues pressurizing the ink pack 87.

If the ball constituting the ink outlet section 86 is pushed unintentionally or intentionally through use of, for example, a pen tip or similar implement, the ink contained in the ink pack 87 gushes forth, thereby soiling the surrounding areas.

Another problem is that ink may leak out from the ink outlet section 86 even when the pushing action is not performed.

In order to prevent occurrence of such problems, there must be taken measures for actively letting the air pressure escape from the inside of the pressure chamber 85, by inserting a hollow needle, such as an injection needle, into the through hole 88*a* of the rubber plug 88 when the ink cartridge is removed from the recording apparatus.

However, such an operation for releasing pressure is cumbersome for the user, and this is not the reliable countermeasure in practice.

Even when the ink cartridge of related-art construction is stored without being attached to the recording apparatus, the ambient temperature change of the location where the ink cartridge is stored, particularly, the ambient temperature increase causes the internal atmospheric pressure of the pressure chamber 85 to increase. Accordingly, ink leaks out from the ink outlet section 86.

A natural approach is to construct an ink cartridge which supplies ink by introducing pressurized air into a case, such that the inside of the case is held hermetic over a long period of time during actual use of the ink cartridge. In addition, consideration of ease of assembly and ease of disassembly and recycling is particularly important. Fulfillment of these requirements is sought strongly.

When primarily text data are to be printed, the ink-jet recording apparatus utilizing the ink cartridge of such construction employs black ink, as is well known. When color printing is to be effected, color inks, such as yellow ink, magenta ink, and cyan ink, are used.

As set forth, the ink is available while an ink pack formed from flexible material in the form of a bag is filled with ink and the ink pack is housed in a cartridge case defining the outer shell of the ink cartridge. The ink cartridges are formed so as to assume substantially identical outer shapes. Further, the ink cartridges are filled with substantially-identical amounts of ink.

In a case where the majority of printedmatter to be produced by a recording apparatus is, for example, text data, the amount of color ink used and the frequency of use of color ink are low. Hence, the color ink cartridges will become empty considerably later than will a black ink cartridge.

For this reason, expiration dates of color ink arrive before the color ink cartridges become empty, thus involving replacement of the ink cartridges with new ink cartridges.

Conversely, when the recording apparatus is used for printing a large number of color images, the amount of black ink used and the frequency of use of black ink are low. The black ink cartridge will become empty much later than will the color ink cartridges. Hence, the expiration date of black ink arrives while black ink still remains in the cartridge.

Thus, in addition to a problem of imposing running costs on the user, there arises another problem of a load of disposing of a considerable amount of ink remaining in an ink cartridge which itself is to be disposed of.

A conceivable measure for diminishing running costs and the load of disposing of ink is to provide an ink cartridge filled with a smaller amount of ink. In this case, there may be adopted regulation means for diminishing the amount of ink contained in an ink pack.

For convenience of attaching a cartridge into a holder of a recording apparatus, the outer shell of an ink cartridge case for housing an ink pack must be of a certain size and shape, regardless of the volume of ink. In an ink cartridge filled with a smaller amount of ink, a large gap arises between the cartridge case and the ink pack.

For example, in the event that an ink pack is freely moved within the cartridge case because of vibration stemming from transport of an ink cartridge; particularly, in the event that the ink pack has experienced excessive physical shock, the ink pack will be broken.

Another conceivable measure to prevent breakage of an ink pack is to make the outer dimensions of cartridge cases identical and to change the internal size and shape of the case in accordance with the amount of ink to be contained. In a case where an attempt is made to adopt such a measure, metal molds to be used for molding ink cartridge cases must be prepared separately for a high-volume ink cartridge and for a low-volume ink cartridge, and costs of the metal molds are reflected in manufacturing costs.

In connection with a recording apparatus which is constructed so as to push ink from an ink cartridge by means of pressurized air and which enables selective use of high-volume ink packs and low-volume ink packs, when low-volume ink cartridges are used, a large amount of pressurized air must be introduced into the cartridge cases.

Consequently, for example, when an attempt is made to activate the recording apparatus by turning on the operating power of the recording apparatus, consumption of a considerable amount of time is required before the recording apparatus becomes able to print, thereby deteriorating the throughput of the recording apparatus.

SUMMARY OF THE INVENTION

The present invention has been conceived in light of the foregoing technical drawbacks and is aimed at providing an ink cartridge which facilitates a process for assembling the outer shell of an ink cartridge including an ink pack, facilitates disassembly and recycling of a waste cartridge case, and can contribute to conservation of resources.

The present invention is also aimed at providing an ink cartridge which supplies ink using air pressure and can prevent gushing or leaking of ink, which would otherwise be caused by residual air pressure or variations in ambient temperature.

The present invention is also aimed at providing an ink cartridge which ensures a stable hermetic state within a case and facilitates assembly and disassembly operations.

The present invention is also aimed at providing an ink cartridge capable of effectively preventing fracture of an ink pack, which would otherwise be caused when an ink cartridge filled with a small volume of ink is subjected to physical shock.

The present invention is also aimed at providing an ink cartridge for use with a recording apparatus which pushes ink from an ink cartridge by utilization of pressurized air, wherein, when a low-volume ink cartridge is used, the ink cartridge can prevent deterioration of throughput of the recording apparatus.

The present invention is also aimed at providing an inkjet recording apparatus suitable for use with the ink cartridge.

To achieve the objects, the present invention provides an ink cartridge for use with a recording apparatus which supplies ink to a recording head by application of pressurized air produced by an air pressurization pump, comprising:

- an ink pack which is formed from ink-filled flexible material and housed in the ink cartridge;
- an outer shell member which is formed by coupling together at least a first outer shell constituent member and a second outer shell constituent member such that the outer shell member is hermetically sealed; and
- a pressure chamber which is formed by the outer shell member and the ink pack and to which the pressurized air produced by the air pressurization pump is to be applied.

Preferably, the first outer shell constituent member and the second outer shell constituent member are hermetically coupled together by vibratory welding.

Preferably, a weld surface is formed over the entirety of a peripheral edge of a lower case acting as the first outer shell constituent member so as to constitute a substantially-flat single plane, and a director which is to be frictionally welded upon contact with the weld surface formed on the peripheral edge of the lower case is formed on a peripheral edge of an upper case acting as the second outer shell constituent member.

Preferably, an upright flange section is integrally formed on the peripheral edge of the lower case serving as the first outer shell constituent member, along the outer periphery of the weld plane.

Moreover, a reinforcement rib is preferably formed preliminarily on a surface of the first outer shell constituent member defining the pressure chamber, as well as on a surface of the second outer shell constituent member defining the pressure chamber.

Preferably, the first outer shell constituent member and the second outer shell constituent member are hermetically coupled together by heat-welding.

Preferably, a weld surface is formed over the entirety of a peripheral edge of a lower case acting as the first outer shell constituent member so as to constitute a substantially-flat single plane, and a heat-welding film acting as the second outer shell constituent member is formed on the weld surface formed on the peripheral edge of the lower case.

Preferably, the ink cartridge further comprises a reinforcement member for covering the outside of the heat-welding film acting as the second outer shell constituent member.

Preferably, an engagement section removably engaging the peripheral edge of the lower case acting as the first outer shell constituent member is formed integrally along the peripheral edge of the reinforcement member.

In this case, a reinforcement rib for preventing deformation caused by air pressure is preferably formed preliminarily on the surface of the first outer shell constituent member defining the pressure chamber.

Preferably, a contact surface is formed over the entirety of a peripheral edge of a lower case acting as the first outer shell constituent member; a contact surface to be brought into close contact with the contact surface formed on the peripheral edge of the lower case is formed on a peripheral edge of a cover acting as the second outer shell constituent member; and an engagement section removably engaging the peripheral edge of the lower case is formed integrally on the cover, thereby maintaining the case and the cover in a sealed state by the action of the engagement section.

In the ink cartridge according to the present invention which has been embodied in the manner as mentioned above, an outer shell member is formed by coupling together at least a first outer shell constituent member and a second outer shell constituent member such that the outer shell member is hermetically sealed. Further, the pressurized air produced by the air pressurization pump is to be applied to a pressure chamber which is formed by the outer shell member and the ink pack.

As a method of hermetically coupling together the first outer shell constituent member and the second outer shell constituent member, vibratory welding can be used.

The first outer shell constituent member and the second outer shell constituent member may be hermetically coupled together by heat welding.

It is also possible to adopt a method of sustaining the first and second outer shell constituent members in a hermetic state such that a contact surface formed on the second outer shell constituent member is arranged so as to come into close contact with a contact surface formed on the first outer shell constituent member.

In a case where the first outer shell constituent member is taken as a lower case and where the second outer shell constituent member is taken as an upper case, an ink-filled ink pack is housed in the lower case preliminarily. In this state, the cover serving as an upper case is hermetically connected to the lower case through use of any one of the above-mentioned methods, thus providing an ink cartridge product.

Consequently, the process of assembling the outer shell of an ink cartridge including an ink pack can be simplified, thus contributing to productivity of a product of this type.

Since the outer shell of the ink cartridge is formed by hermetically coupling or joining together the first and second outer shell constituent members, disassembly and recycling of a waste cartridge are facilitated, thereby contributing to conservation of resources.

The present invention also provides an ink cartridge constructed so as to supply ink to a recording head by application of pressurized air produced by an air pressurization pump, comprising:

- an ink pack which is formed from ink-filled flexible material and housed in the ink cartridge;
- a pressure chamber which is formed between an outer shell member of the ink cartridge and the ink pack and to which the pressurized air produced by the air pressurization pump is to be applied;

a pressurized air inlet port which is formed in the outer shell member of the ink cartridge for enabling introduction of the pressurized air supplied from the air pressurization pump; and an ink outlet section which is formed in the ink pack and enables outflow of ink from the ink pack, wherein, when the ink cartridge is removed from the recording apparatus, the pressurized air inlet port is released, to thereby bring the pressure chamber in communication with the atmosphere, and the ink outlet section is brought into a closed state.

In this case, the pressurized air inlet port is preferably formed integrally with the outer shell member of the cartridge and from a cylindrical member which defines an air channel communicating with the pressure chamber.

Preferably, the ink outlet section provided in the ink pack is equipped with a valve member, wherein, when the ink cartridge is mounted to a recording apparatus, the valve member comes into contact with a connection section of the recording apparatus and recedes in an axial direction, thus becoming open. Further, when the ink cartridge is removed from the recording apparatus, the valve member advances in the axial direction, thus sustaining a closed state.

In this case, in the preferred embodiment, the ink outlet section is equipped with a spring member for urging the valve member so as to advance in the axial direction.

In addition, the ink outlet section is exposed to the outside of the outer shell member through an opening section formed in the outer shell member of the ink cartridge, and an O-ring is interposed between the opening section and the ink outlet section. Further, an engagement member is preferably provided for establishing a sealed state between the opening section and the ink outlet section by pressing the O-ring.

In the ink cartridge according to the present invention, when the ink cartridge is mounted to a recording apparatus, pressurized air produced by the air pressurization pump is introduced into the pressure chamber from the pressurized-air inlet port. The ink filled in the ink pack is supplied to the recording apparatus through the ink outlet section upon receipt of pressurized air.

When the ink cartridge is removed from the recording apparatus, the pressurized-air inlet port—which is formed in the outer shell member of the ink cartridge and is formed cylindrically—is released, whereby the pressure chamber is immediately brought into communication with the atmosphere. Consequently, the ink pack stored in the ink cartridge is also immediately released from a pressurized state.

Therefore, a problem of gushing or leakage of ink from the ink outlet section provided in the ink pack can be eliminated.

Even in a state in which an ink cartridge is not mounted to the recording apparatus and is stored, the pressure chamber is in communication with the atmosphere at all times, thus eliminating an influence of ambient temperature.

The present invention also provides an ink cartridge for use with a recording apparatus including: an ink pack formed from ink-filled flexible material and filled with ink, and a cartridge case hermetically formed for housing the ink pack, wherein, when the ink cartridge is mounted to a recording apparatus, pressurized air is introduced into the cartridge case, comprising:

first and second cases which constitute the cartridge case;

a flange section formed along an edge of an opening of the first case; and a lug-shaped member which is formed on the second case and engages with the flange section, thereby coupling the first and second cases together.

Preferably, as an ink pack is housed in the first case, the edge of the opening of the case is sealed by a film member, thus realizing a sealed state, and the second case serves as a cover for preventing expansion of the film member when the film member receives pressurized air.

In this case, a tapered surface and an engagement step section are preferably formed on each lug-shaped member such that, when the second case is attached to the first case, the tapered surface goes beyond the flange section formed on the first case and such that the engagement step section engages the flange section.

Preferably, the second case has a planar section acting as a cover and a fold section formed integral with and perpendicular to the planar section, and the lug-shaped member is formed on an interior surface of the fold section.

In this case, a plurality of independent lug-shaped members are preferably formed intermittently on an interior surface of the fold section. Preferably, slit holes are formed through a planar section of the second case to correspond in location to the plurality of independent lug-shaped members, along the fold section.

In a preferred embodiment, a film member is sealed to the edge of the opening of the first case by heat welding.

In the ink cartridge according to the present invention, the ink pack which is formed from flexible material and is filled with ink is sealed with a film member while housed in the first case.

The second case is joined to the first case housing the ink pack, whereby the second case acts as a cover for preventing expansion of the film member when the film member is subjected to pressurized air.

Consequently, the hermetic state of the ink cartridge is ensured by the film member. Deformation of the film member, which would otherwise be caused when the film member is subjected to pressurized air, is effectively prevented by the second case acting as a cover.

In a case where the second case is coupled or joined to the first case, the lug-shaped member formed on the second case is engaged with the flange section formed along the edge of the opening of the first case. The first and second cases are joined together, thus constituting the outer shell of the ink cartridge.

Consequently, assembly and disassembly of an ink cartridge are readily achieved, thereby contributing to improving the ease of recycling of the constituent members of the ink cartridge.

The lug-shaped member formed on the second case is formed on the interior surface of the fold section perpendicular to the plane section acting as a cover. The provision of a tapered surface and an engagement section which go beyond the flange section formed on the first case, makes it easy to join the first case and the second case together. That is, a simple operation of stacking the first and second cases, and pushing one to the other can join the first and second cases. Accordingly, this arrangement contributes to ease of assembly of an ink cartridge.

Since the slit holes are formed through the planar section of the upper case to correspond in location to the lug members along the fold section, the fold section having the lug members formed thereon can be improved in terms of ease of flexure. The ease of flexure of the fold section effectively acts to provide relief when the tapered surface of each of the lug members goes beyond the flange section of the first case.

With such relief, it is possible to effectively avoid, for example, a problem of whitening of the area in which the lug members are formed or a problem of cracks, which would otherwise be caused when undue stress acts on the lug members when the upper and lower cases, both being made of synthetic resin, are attached together.

In the ink cartridge having the foregoing construction, when the ink cartridge is mounted to a recording apparatus and pressurized air is introduced into a case, the planar section of the second case undergo slight outward deformation by way of the film member, and consequently the lug-shaped member formed on the interior surface of the fold section orthogonal to the planar section is inwardly inclined due to the deformation of the planar section.

Therefore, the lug-shaped member positively engages the flange section of the second case, thereby sustaining the first and second cases in a strongly coupled state.

The present invention also provides an ink cartridge for use with a recording apparatus including an ink pack formed from flexible material and filled with ink and a cartridge case which houses the ink pack and constitutes an outer shell, comprising:

an ink pack press member which is housed in the cartridge case along with the ink pack and which adjusts the volume of ink to be poured into the ink pack in accordance with the volume of the press member.

Preferably, the ink pack is formed into a substantially rectangular shape and into a bag by sealing four sides of the ink pack, and the press member housed in the cartridge along with the ink pack is formed into a frame shape having a window-shaped opening in the central portion thereof. Further, four sides of the ink pack are pressed by the frame-shaped press member.

In this case, the portions of the press member opposing the four sides of the ink pack are formed into tapered shapes such that the portions become gradually thinner toward the window-shaped opening formed in the center of the press member to define slope surfaces.

Preferably, the slope surfaces are formed into curved surfaces, and the press member is formed from resilient material.

Preferably, the cartridge case is hermetically formed, and, as pressurized air is introduced into the case while the ink cartridge is mounted to a recording apparatus, the ink pack is pressurized by air pressure.

Preferably, the cartridge case is formed from a first case and a second case, and an ink pack and a press member are housed in the first case. Further, the edge of the opening of the case is sealed by a film member, thus realizing a sealed state. The second case prevents expansion of the film member, which would otherwise be caused when the film member receives pressurized air.

Preferably, a lug-shaped member is formed on the second case. A tapered surface and an engagement step section are formed on each lug-shaped member such that, when the second case is attached to the first case, the tapered surface goes beyond the flange section formed on the first case and such that the engagement step section engages the flange section.

In the ink cartridge according to the present invention, an ink pack which is formed from flexible material and is filled with ink is housed in a cartridge case along with an ink pack press member. In accordance with the volume of the press member, the volume of ink to be poured into the ink pack can be regulated.

In other words, a plurality of types of press members of different volumes are prepared. In accordance with the volume of ink filled in the ink pack, a press member is selected and housed in the cartridge case. The ink pack can be housed in the case without involvement of a large clearance and so as to substantially occupy the internal space of the case.

Without regard to whether the volume of ink filled in an ink pack is large or small, free movement of an ink pack within the cartridge case can be effectively prevented. As mentioned above, a problem of damage to an ink pack when the ink pack is subjected to physical shock during transport can be eliminated.

In this case, a window-shaped opening is formed in the center of the press member, whereby an ink-filled ink pack formed into a bag shape is retained by the press member such that the peripheral edge of the ink pack is pressed.

Consequently, the press member can be housed in the case to smoothly match the outer geometry of the ink pack. Therefore, holding of an ink pack when the ink pack is subjected to physical shock can be improved to a much greater extent.

When the foregoing configuration is applied to an ink cartridge in which pressurized air is introduced into a cartridge case, a press member whose volume is selected in accordance with the volume of ink filled in an ink pack is housed, and hence the volume of pressurized air to be introduced into the cartridge case can be caused to fall within a predetermined range.

Hence, there can be prevented a time lag that would arise from the time a recording apparatus is powered up to the time the recording apparatus enters a standby state, thereby improving throughput of the recording apparatus.

The present invention also provides an ink-jet recording apparatus into which an ink cartridge as defined in any one of claims 1 through 31 can removably mounted, comprising:

a recording head which is mounted on a carriage and reciprocatingly moved in a widthwise direction of recording paper; and a sub-tank which is replenished with ink from an ink cartridge through an ink supply channel and supplies ink to the recording head, wherein ink is supplied from the ink cartridge to the sub-tank by the action of air pressure applied to the ink cartridge.

In this case, the ink supply channel extending from the ink cartridge to the sub-tank is preferably formed from a flexible ink supply tube.

In a preferred embodiment, an ink supply valve is further provided in the ink supply channel extending from the ink cartridge to the sub-tank, and the ink supply valve is opened or closed in accordance with a control signal produced by ink level detection means for detecting the volume of ink remaining in the sub-tank.

In addition, an annular packing member is preferably provided in a cartridge holder to which the ink cartridge is removably mounted, and, while the ink cartridge is mounted the cartridge holder, the annular packing member comes into close contact with an outer peripheral surface of a cylindrical member which defines an air channel communicating with a pressure chamber of the ink cartridge.

In a preferred embodiment, a cartridge holder to which the ink cartridge is removably mounted is provided with an open/close valve unit which, when the ink cartridge is mounted to the cartridge holder, comes into contact with an ink outlet section of the ink cartridge and recedes axially, thus becoming open; and wherein, when no ink cartridge is mounted to the cartridge holder, the open/close valve unit advances axially, thus maintaining a closed state.

In this case, the open/close valve unit is preferably provided with a hollow needle having an ink inlet hole and a slide member; and wherein, when no ink cartridge is mounted to the cartridge holder, upon receipt of urging force of the spring member the slide member moves to a position where the slide member closes the ink inlet hole formed in the hollow needle.

In the ink-jet recording apparatus to which the ink cartridge according to the present invention is to be mounted, a required and sufficient amount of ink can be supplied to the sub-tanks provided on the carriage by the action of pressurized air.

Consequently, even in a recording apparatus in which ink is supplied to a sub-tank through a flexible ink supply tube from an ink cartridge, printing can be effected continuously without being affected by the dynamic pressure of the ink supply tube.

An open/close unit which advances in the axial direction when no ink cartridge is mounted to the cartridge holder, to thereby sustain a closed state is provided in a cartridge holder provided to the recording apparatus. As a result, when no ink cartridge is mounted to the cartridge holder, the open/close valve unit axially advances and is maintained closed, thereby preventing a problem of contamination, which would otherwise be caused by reverse flow of ink from the sub-tank.

The present disclosure relates to the subject matter contained in Japanese patent application Nos.

Hei. 11-288421 (filed on Oct. 8, 1999), 2000-21020 (filed on Jan. 31, 2000), 2000-24419 (filed on Feb. 1, 2000), 2000-186050 (filed on Jun. 21, 2000), 2000-201983 (filed on Jul. 4, 2000), 2000-12461 (filed on Jan. 21, 2000), and 2000-12462 (filed on Jan. 21, 2000), which are expressly incorporated herein by reference in their entireties.

DESCRIPTION OF THE PREFERRED EMBODIMENT

Examples of an ink cartridge according to the present invention and an ink-jet recording apparatus using the ink cartridge will be described by reference to illustrated preferred embodiments.

Ink-Jet Recording Apparatus

Figure 1:
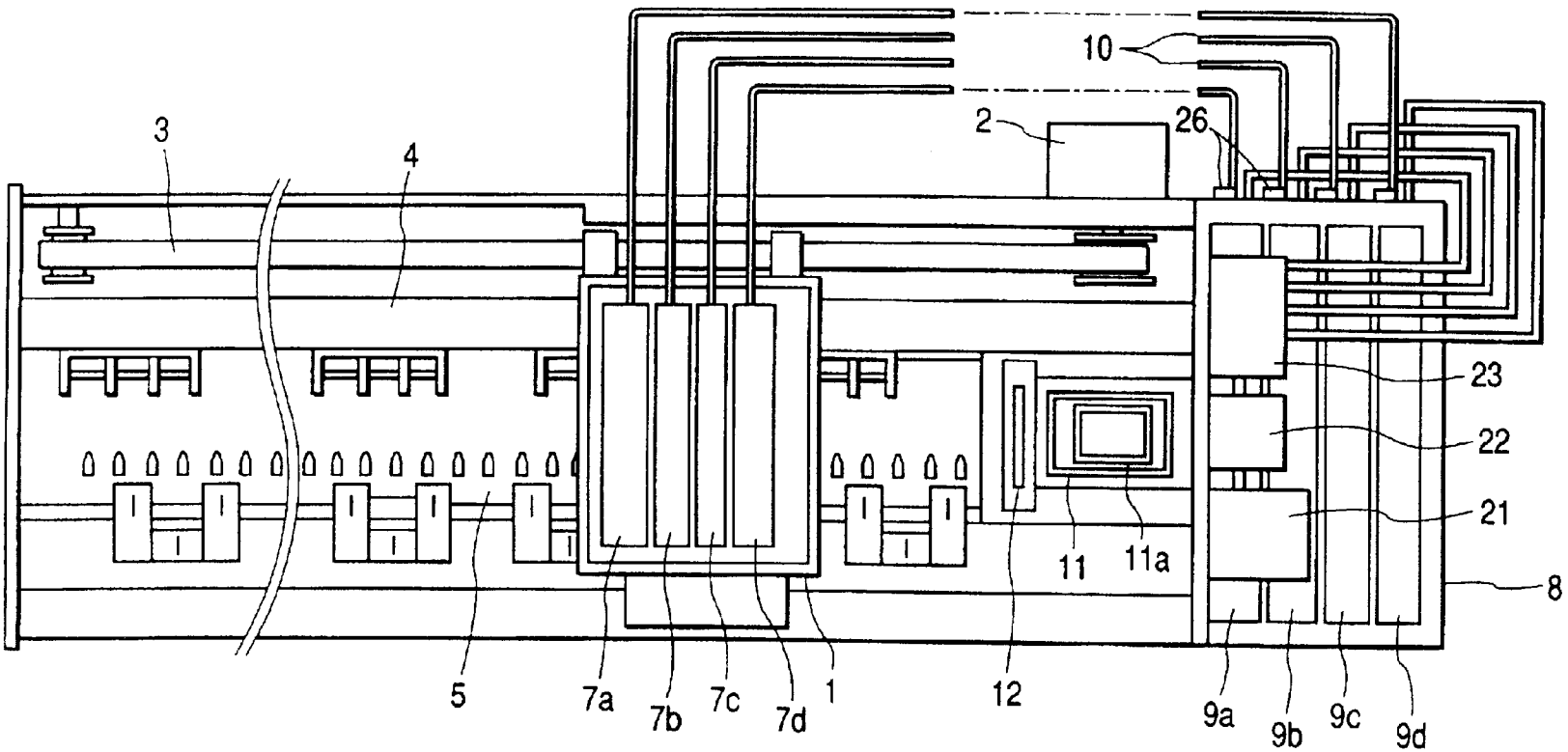
FIG. 1 is a top view showing an example of an ink-jet recording apparatus capable of using ink cartridges according to the present invention.

FIG. 1 is a top view showing an example of an ink-jet recording apparatus capable of using ink cartridges according to the present invention.

As shown in FIG. 1, reference numeral 1 designates a carriage. The carriage 1 is constructed so as to cause reciprocatory movement in the longitudinal direction of a paper feed member 5; that is, in the primary scanning direction identical with the widthwise direction of recording paper, while being guided by a scan guide member 4 by way of a timing belt 3 driven by a carriage motor 2.

Although not shown in FIG. 1, an ink-jet recording head 6 to be described later is mounted on the surface of the carriage 1, which surface opposes the paper feed member 5. Sub-tanks 7*a* through 7*d* for supplying ink to the recording head are mounted on the carriage 1.

In the present embodiment, four sub-tanks 7*a* through 7*d* are provided so as to correspond to the types of ink and for temporarily storing the ink therein.

The sub-tanks 7*a* through 7*d* are constructed such that black ink, yellow ink, magenta ink, and cyan ink are supplied to the sub-tanks 7*a* through 7*d* from corresponding main tanks 9*a* through 9*d* through flexible ink supply tubes 10, respectively. The main tanks 9*a* through 9*d*, i.e. ink cartridges, are attached to a cartridge holder 8 provided on the apparatus main body of the recording apparatus.

Capping means 11 capable of sealing a nozzle-formed plane of the recording head is disposed in a non-print region (i.e., at the home position) on the travel path of the carriage 1. A cap member 11*a*—which is formed from flexible material, such as rubber, that is capable of sealing a nozzle-formed plane of the recording head—is attached to the upper surface of the capping means 11.

The cap member 11*a* is designed to seal the nozzle-formed plane of the recording head when the carriage 1 is moved to the home position.

During the non-operating period of the recording apparatus, the cap member 11*a* seals the nozzle-formed plane of the recording head, thereby acting as a cover for preventing drying of nozzle orifices. Although not depicted, one end of a tube of a suction pump (i.e., a tube pump) is connected to the cap member 11*a*, so that negative pressure generated by the suction pump is applied to the recording head, to thereby perform a cleaning operation for causing the recording head to discharge ink under suction.

A wiping member 12 formed from resilient material, such as rubber, is disposed adjacent to the capping means 11 and in a print region side with respect to the capping means 11 so as to wipe and clean the nozzle-formed plane of the recording head as required.

Figure 2:
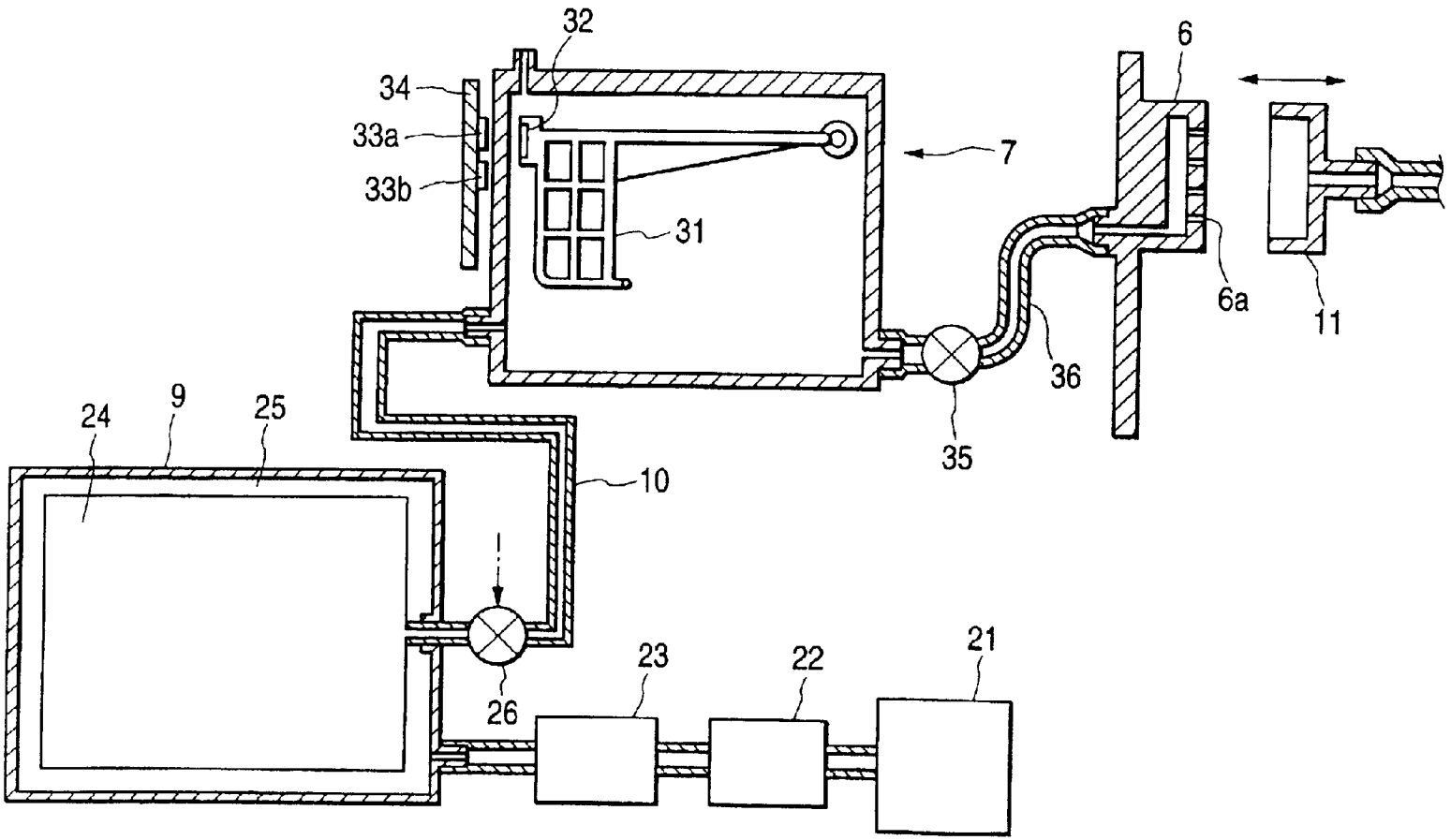
FIG. 2 is a schematic drawing showing an ink supply system extending from an ink cartridge to a recording head in the recording apparatus shown in FIG. 1.

FIG. 2 is a schematic drawing showing an ink supply system extending from an ink cartridge to a recording head in the recording apparatus shown in FIG. 1. The ink supply system will now be described by reference to FIG. 2 in conjunction with FIG. 1, in which like elements are assigned like reference numerals.

Referring to FIGS. 1 and 2, reference numeral 21 designates an air pressurization pump constituting a pressurization unit. The air pressurized by the air pressurization pump 21 is supplied to a pressure regulation valve 22. The pressurized air is supplied to the respective main tanks 9*a* through 9*d* (the main tanks are designated in FIG. 2 by simply reference numeral 9, and the main tanks will often be described in singular form by use of only reference numeral 9) by way of a pressure detector 23.

The pressure regulator valve 22 has the function of maintaining the air pressure applied to the respective main tanks 9*a* through 9*d* within a predetermined range by releasing pressure when the air pressurized by the air pressurization pump 21 has reached a predetermined pressure level or greater.

The pressure detector 23 operates so as to detect the air pressurized by the air pressurization pump 21 and control the operation of the air pressurization pump 21.

More specifically, when having detected that the air pressurized by the air pressurization pump 21 has reached a predetermined pressure level, the pressure detector 23 stops actuation of the pressurization pump 21 on the basis of the detection result. In contrast, when having detected that the air pressure has fallen below a predetermined pressure level, the pressure detector 23 performs control operation so as to actuate the air pressurization pump 21. By repetition of these operations, the air pressure applied to the main tanks 9*a* through 9*d* is maintained within the predetermined range.

The detailed construction of the main tank 9 will be described later. As the construction of the main tank 9 is schematically shown in FIG. 2, the outer shell of the main tank 9 is formed hermetically. An ink pack 24 which is filled with ink and is formed from resilient material is housed in the main tank 9.

The space defined by combination of the main tank 9 and the ink pack 24 constitutes a pressure chamber 25, and the pressurized air is supplied to the pressure chamber 25 by way of the pressure detector 23.

With such a construction, the ink packs 24 housed in the main tanks 9*a* through 9*d* are subjected to pressure stemming from the pressurized air, whereby ink flows from the main tanks 9*a* through 9*d* to the corresponding sub-tanks 7*a* through 7*d* under predetermined pressure.

The ink pressurized in each of the main tanks 9*a* through 9*d* is supplied to the corresponding one of the sub-tanks 7*a* through 7*d* mounted on the carriage 1, by way of the corresponding one of ink supply valves 26 and the corresponding one of the ink supply tubes 10 (the sub-tanks are designated in FIG. 2 by use of simply reference numeral 7, and hereinafter the sub-tanks will often be described in singular form by use of simply reference numeral 7).

As shown in FIG. 2, a float member 31 is provided within the sub-tank 7, and a permanent magnet 32 is attached to a part of the float member 31. Magnetoelectric converter elements 33*a* and 33*b* typified by Hall elements are mounted on a board 34, and the board 34 is disposed in close proximity to the side wall of the sub-tank 7.

With such an arrangement, the permanent magnet 32 provided on the float member 31 and the Hall elements 33*a* and 33*b* constitute ink level detection means. In accordance with the amount of lines of magnetic force developing in the permanent magnet 32 according to the position of the float member 31, an electrical output is produced by the Hall elements 33*a* and 33*b*.

When the level of the ink stored in the sub-tank 7 has lowered, the float member 31 housed in the sub-tank 7 is moved under the force of gravity. In association with this movement, the permanent magnet 32 is also moved in the same direction.

The electrical output produced by the Hall elements 33*a* and 33*b* in association with movement of the permanent magnet 32 can be sensed as the level of the ink stored in the sub-tank 7. On the basis of the electrical output produced by the Hall elements 33*a* and 33*b*, the ink supply valve 26 is opened. As a result, the pressurized ink in the main tank 9 is supplied to each corresponding sub-tank 7 whose ink level has lowered.

When the ink stored in the sub-tank 7 has risen to a predetermined level, the ink supply valve 26 is closed on the basis of the electrical output produced by the Hall elements 33*a* and 33*b*.

By repetition of these operations, ink is intermittently supplied from the main tank 9 to the sub-tank 7, thereby constantly storing substantially a given amount of ink within each sub-tank 7.

The sub-tank 7 is constructed such that ink is supplied from the sub-tank 7 to the recording head 6 by way of a valve 35 and a tube 36 connected thereto. On the basis of print data supplied to an unillustrated actuator of the recording head 6, ink droplets are ejected from nozzle orifices 6*a* formed in the nozzle-formed plane of the recording head 6.

Referring to FIG. 2, reference numeral 11 designates the previously-described capping means, and a tube connected to the capping means 11 is connected to an unillustrated suction pump (i.e., a tube pump).

Ink Cartridge

Ink cartridges according to embodiments of the present invention will be described sequentially from an ink cartridge according to a first embodiment.

First Embodiment

Figure 3:
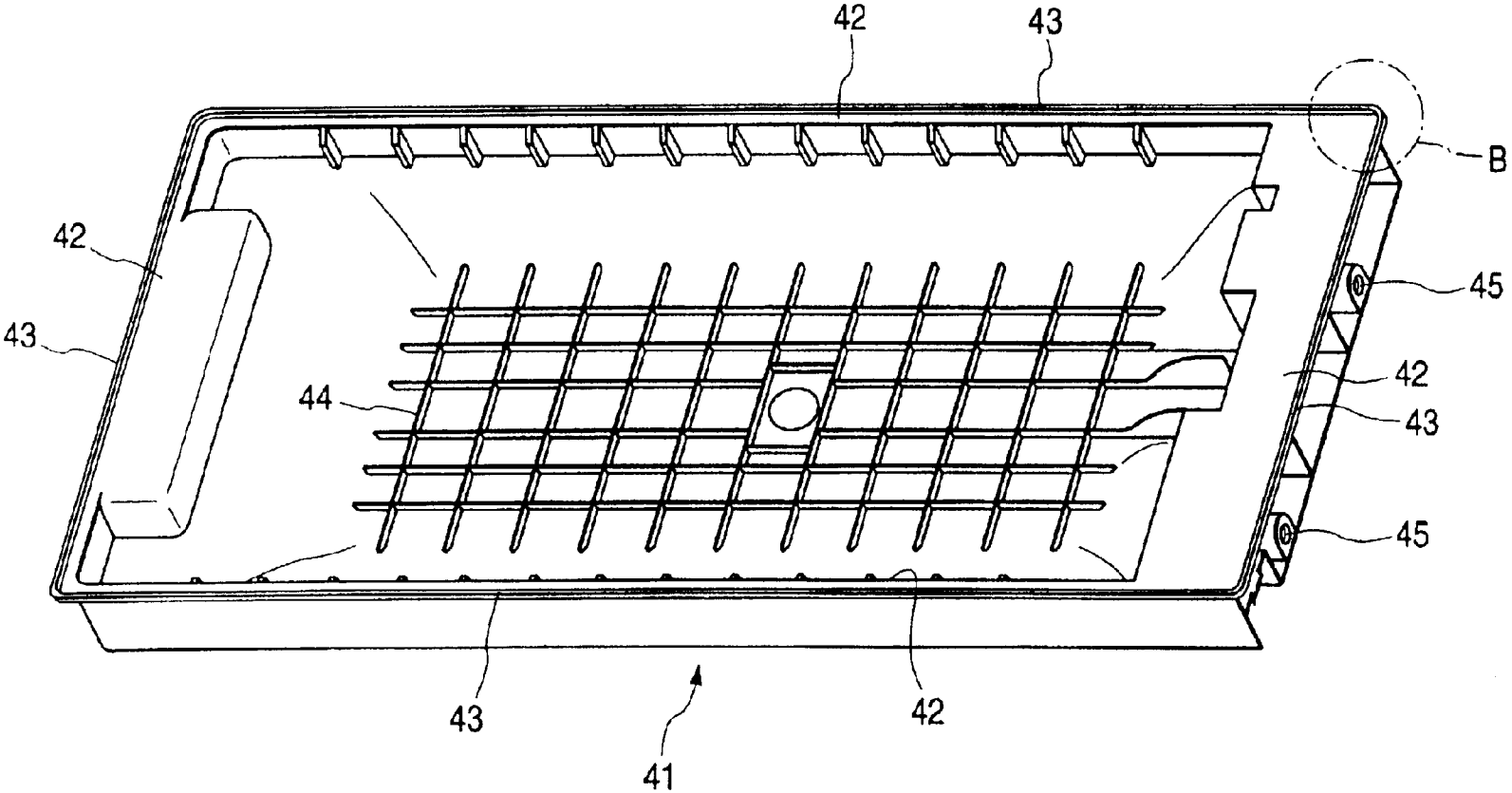
FIG. 3 is a perspective view showing the construction of a lower case constituting the outer shell of the ink cartridge according to the present invention.
Figure 4:
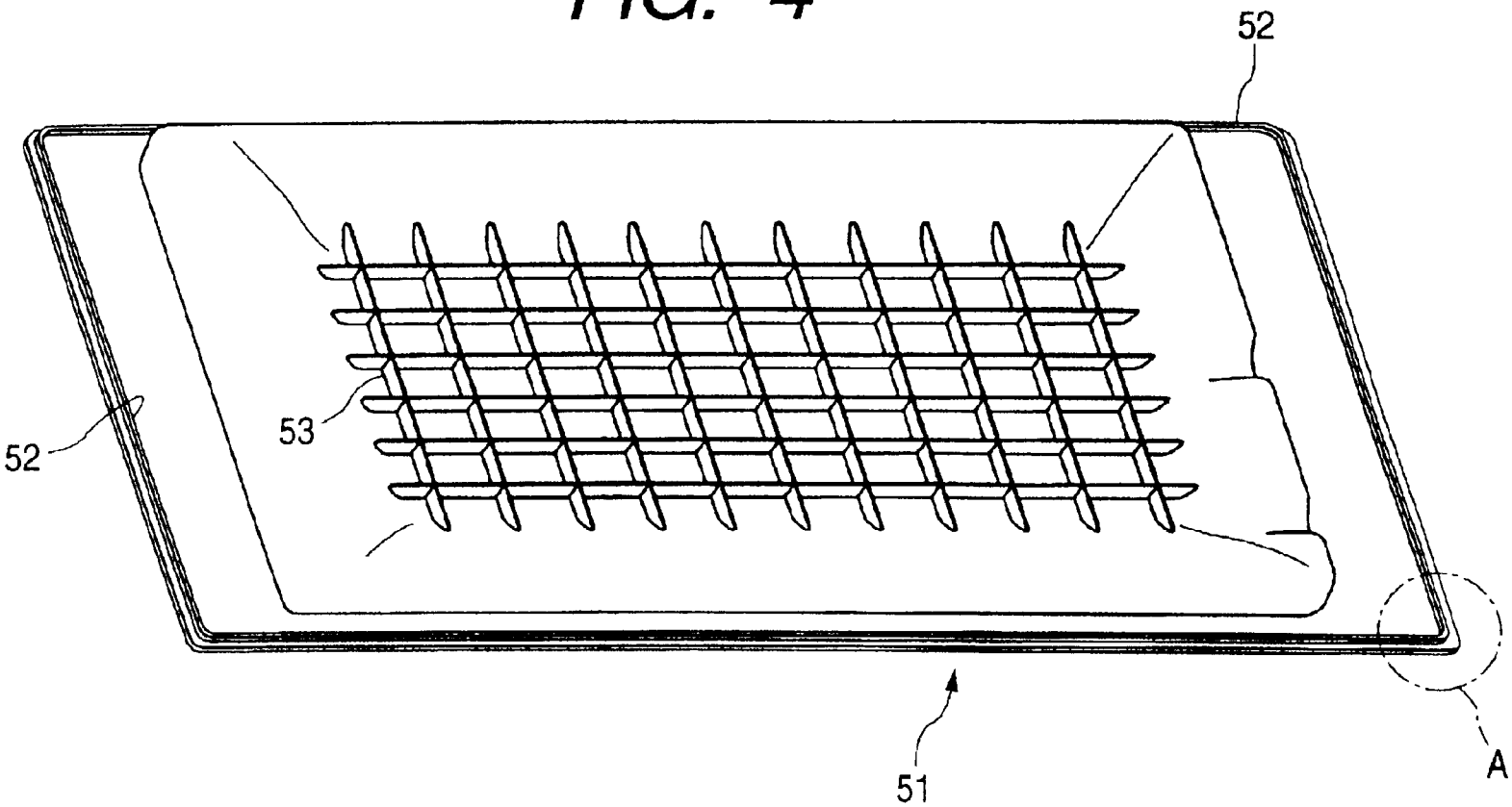
FIG. 4 is a perspective view showing the construction of an upper case constituting the outer shell of the ink cartridge according to the present invention.

FIGS. 3 through 5 illustrate an example ink cartridge (main tank) according to the first embodiment of the present invention to be used with the ink-jet recording apparatus.

FIG. 3 is a perspective view showing the overall construction of a lower case which constitutes the outer shell of the main tank and acts as a first outer shell constituent member. A lower case 41 is formed in a flattened box-shaped form. The upper surface of the lower case 41 is opened, and an ink pack 24 filled with ink is housed in the lower case 41.

A continues weld surface 42 is formed along the entirety of the peripheral edge of the lower case 41 so as to be located on a substantially-flat single imaginary plane. An upright flange section 43 is integrally formed on the peripheral edge of the lower case 41 along the outer periphery of the weld surface 42.

Figure 5A:
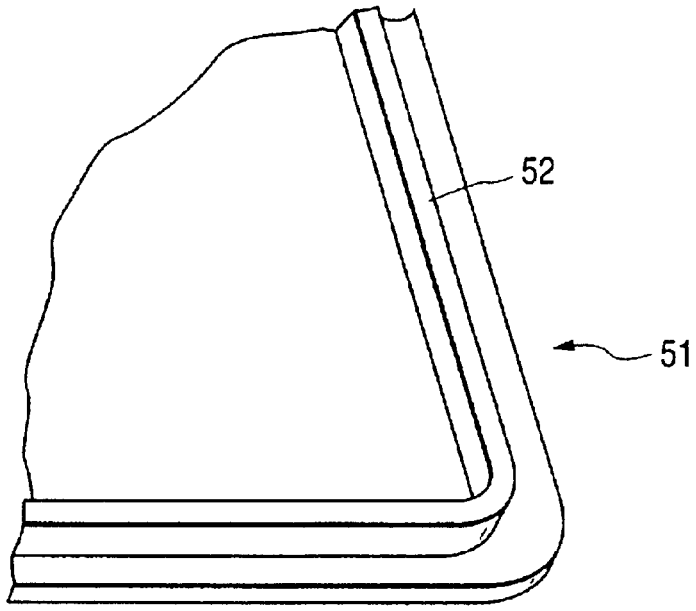
FIG. 5A is an enlarged view of a corner section of the upper case shown in FIG. 4.
Figure 5B:
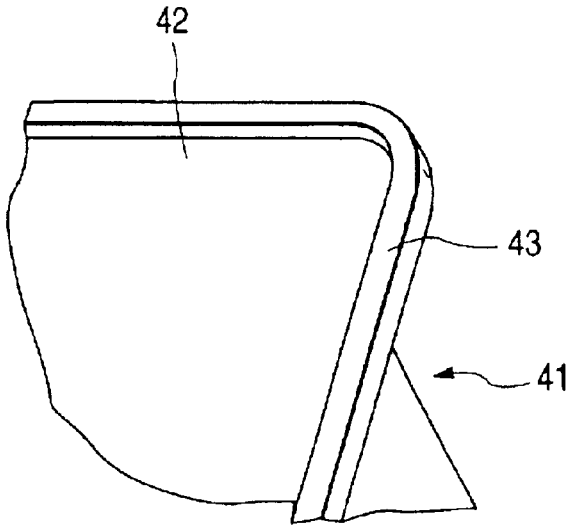
FIG. 5B is an enlarged view of a corner section of the upper case shown in FIG. 3.

FIG. 5B is an enlarged view of a corner section designated by B in FIG. 3.

As will be described later, the upright flange section 43 is formed to prevent splashing of particles, which would otherwise be caused when a director (material to be welded) formed on an upper case is scraped frictionally in a case where the upper case—which acts as a second outer shell constituent member—is fixed to the lower case 41 shown in FIG. 3 by vibratory welding, as will be described later.

Grid-shaped reinforcement ribs 44 are formed on the bottom surface of the lower case 41, a surface of the lower case 41 used for defining the pressure chamber 25, to prevent deformation of the lower case 41 caused by air pressure.

In a case where the lower case 41 is formed by, for example, injection molding, the reinforcement ribs 44 are formed integrally and simultaneously with the lower case 41. As will be described later, the upper case is hermetically attached to the lower case 41 to define an internal pressure chamber. In this case, the grid-shaped reinforcement ribs 44 prevent occurrence of deformation, which would otherwise be caused in the direction orthogonal to the surface of the lower case 41 by the air pressure applied to the internal pressure chamber.

In other words, forming the grid-shaped reinforcement ribs 44 in the manner as mentioned above enables an increase in the strength of the lower case 41 in the direction orthogonal to the surface of the lower case 41. Hence, the present embodiment can also contribute to a reduction in the amount of synthetic resin used for forming a lower case.

In this case, even when the reinforcement ribs 44 are formed on the exterior of the lower case 41, the same reinforcing effects are obtained. In a case where the grid-shaped ribs 44 shown in FIG. 3 are formed on the exterior of the lower case 41, it is difficult to affix on a cartridge a label with a mark showing the trade name or identification of the cartridge. For this reason, forming the ribs 44 on the bottom surface of the lower case 41 in the manner as shown in FIG. 3 is desirable.

As shown in FIG. 3, a pair of guide holes 45 are formed on a longitudinal end of the lower case 41. In a case where the outer shell of an ink cartridge is constituted by the lower case 41 in conjunction with the upper case to be described later, the guide holes 45 are fitted to and positioned by a pair of guide pins provided on the cartridge holder of the recording apparatus.

Next, FIG. 4 shows the overall construction of the upper case constituting the main tank. An upper case 51 is formed into a flattened box-shaped form, with the center thereof being recessed slightly. The upper case 51 is constructed so as to act as a cover of the lower case 41.

A continuous director (e.g., material to be welded) 52 which is to be frictionally welded upon contact with the weld surface 42 is formed along the periphery of the upper case 51, so as to be located on a substantially-flat single imaginary plane. FIG. 5A shows an enlarged view of the corner section designated by A shown in FIG. 4.

As in the case of the lower case 41, grid-shaped reinforcement ribs 53 are formed on the ceiling lower surface of the upper case 51, i.e. the surface of the upper case 51 defining the pressure chamber 25, to prevent deformation of the surface of the upper case 51, which would otherwise be caused by air pressure.

In a case where the upper case 51 is formed by, for example, injection molding, the reinforcement ribs 53 are formed integrally and simultaneously with the upper case 51. In a case where the upper case 51 is hermetically attached to the lower case 41, thereby constituting the internal pressure chamber, the grid-shaped reinforcement ribs 53 prevent deformation, which would otherwise arise in the direction orthogonal to the surface of the upper case 51 by the air pressure applied to the internal pressure chamber.

As mentioned above, even in the case of the upper case 51, the reinforcement ribs 53 are formed on the ceiling lower surface (i.e. an internal surface) of the upper case 51, thus giving consideration to preventing difficulty in affixing on the surface of a cartridge a label of mark representing the trade name or identification of the cartridge.

Figure 6:
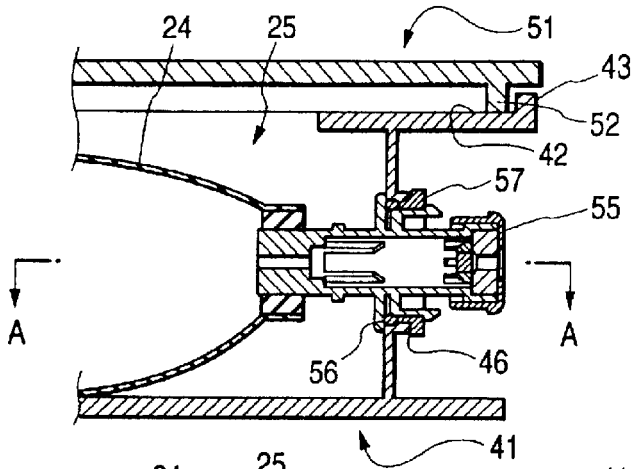
FIG. 6 is a cross-sectional view showing a state in which the upper case is fixed to the lower case by means of vibratory welding.
Figure 7:
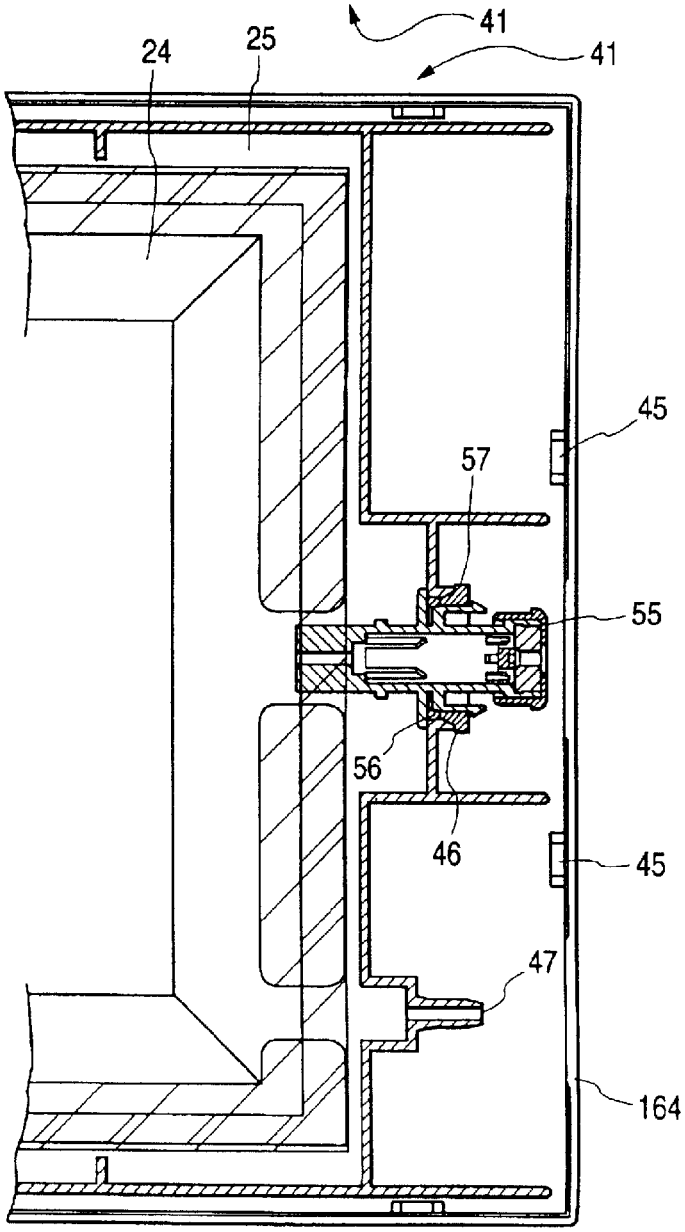
FIG. 7 is a cross-sectional view of the upper and lower cases when viewed from line A—A shown in FIG. 6 in the direction designated by arrows.

FIG. 6 is a cross-sectional view showing a state in which the upper case 51 is fixed to the lower case 41 by vibratory welding, and FIG. 7 is a cross-sectional view taken along an arrow line A—A shown in FIG. 6. In FIGS. 6 and 7, elements identical with those which have already been described are assigned the same reference numerals.

As shown in FIGS. 6 and 7, the ink pack 24 which has been filled with ink preliminarily is housed in the lower case 41 from above, prior to vibratory welding. An ink outlet section 55 which seals the ink pack 24 and constitutes an ink outlet port is exposed outside the lower case 41 by way of an opening section 46 formed in the side end section of the lower case 41.

In this state, an O-ring 56 is abuttingly provided to the opening section 46, and an annular engagement member 57 is pushed and fitted to the opening section 46 from the outside of the lower case 41, so that the ink outlet section 55 of the ink pack 24 can be attached to the opening section 46 of the lower case 41.

As mentioned above, the ink outlet section 55 of the ink pack 24 is attached to the lower case 41 such that the annular engagement member 57 compresses the O-ring 56 fitted to the opening 46. Hence, the space between the opening section 46 formed in the lower case 41 and the ink outlet section 55 of the ink pack 24 is sealed hermetically.

After the ink pack 24 has been installed in the interior of the lower case 41 in this way, the upper case 51 is laid on the lower case 41, and the cases 41 and 51 are joined by vibratory welding. Reference numeral 47 shown in FIG. 7 designates an air inlet port to which pressurized air generated by the previously-described air pressurization pump is supplied.

Figure 8A:
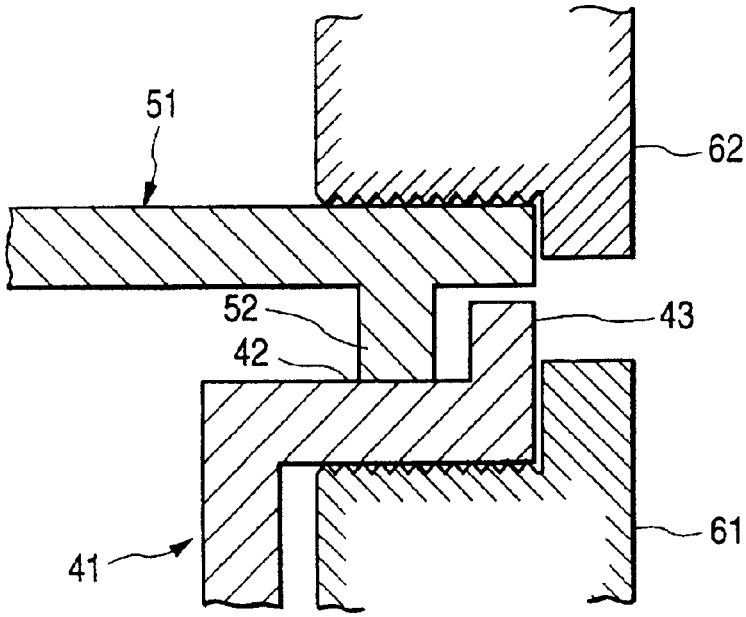
FIGS. 8A and 8B are enlarged schematic diagrams showing portions of the upper and lower cases when they are fixed together by means of vibratory welding.
Figure 8B:
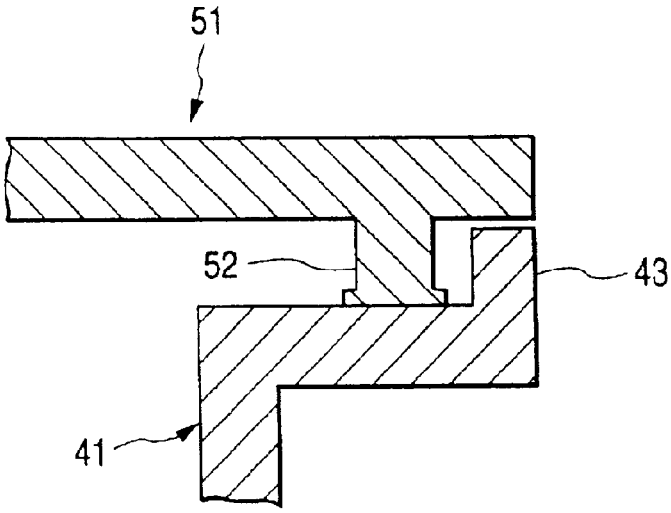

FIGS. 8A and 8B are enlarged diagrams showing a portion of the lower case 41 and a portion of the upper case 51 when the cases 41 and 51 are joined by vibratory welding. More specifically, as shown in FIG. 8A, the peripheral edge of the lower case 41 is supported from below by a stationary vibratory welding jig 61. The peripheral edge of the upper case 51 is pressed from above by a movable vibratory welding jig 62.

As shown in FIG. 8A, upon receipt of driving force from an unillustrated actuator, the movable vibratory welding jig 62 operates so as to apply load to the upper case 51 in the direction of gravity and horizontal vibration to the same.

The director 52 formed on the upper case 51 is slid on the weld surface 42 of the lower case 41 while the load is applied to the director 52.

By frictional heat developing between the director 52 and the weld surface 42, a portion of the director 52 formed on the upper case 51 and a portion of the weld surface 42 formed on the lower case 41 are fused.

While application of load to the upper case 51 is maintained, horizontal vibratory movement of the movable vibratory welding jig 62 is stopped, so that the upper case 51 is hermetically joined to the lower case 41 as shown in FIG. 8B.

As mentioned previously, the upright flange section 43 is formed along the outer periphery of the weld surface 42 of the lower case 41. Even if the director 52 formed on the upper case 51 generates particles during the course of vibratory welding operation, the upright flange section 43 can diminish the extent of the particle splash.

The outer shell which is constructed in the manner as mentioned above and serves as an ink cartridge is hermetically formed, by fused resin of the upper and lower cases 51 and 41. Accordingly, the outer shell can be preferably adopted for use with an ink-jet recording apparatus constructed so as to introduce air pressure into main tanks serving as ink cartridges as described above.

The foregoing description shows an example in which the upper case acting as the second outer shell constituent member is hermetically welded, by vibratory welding, to the lower case acting as the first outer shell constituent member. Heat welding means, which will be described later, can be utilized as means for hermetically fixing together the upper and lower cases.

Figure 9A:
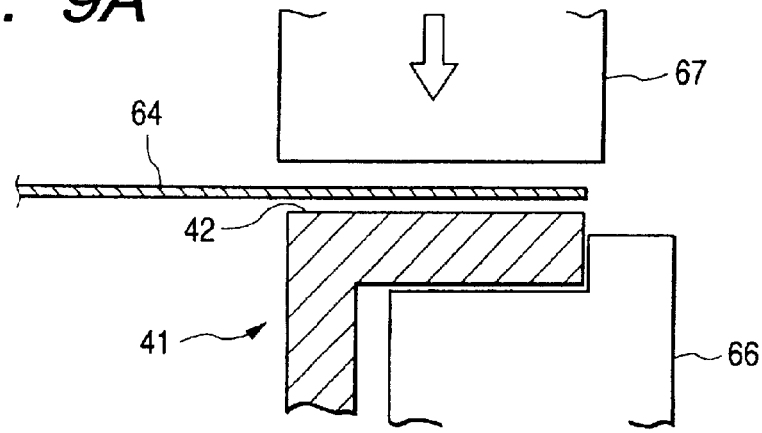
FIGS. 9A and 9B are enlarged views showing a part of the lower case when a heat-welding film is welded to the upper surface of an opening of the lower case.
Figure 9B:
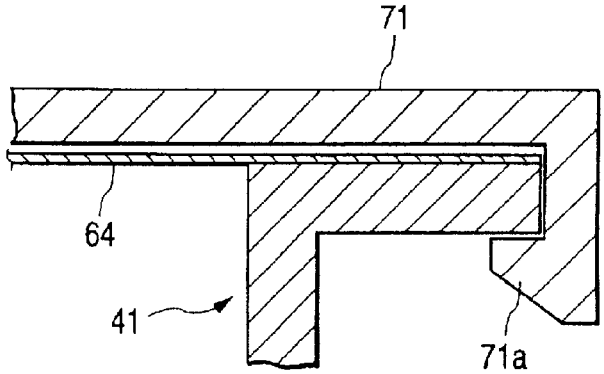

FIGS. 9A and 9B are schematic representations showing a state in which a film-shaped member 64 serving as the second outer shell constituent member is heat-welded to the lower case 41 serving as the first outer shell constituent member.

In this case, a member analogous in construction to the case which has already been described by reference to FIG. 3 is used as a lower case.

As in the case of the vibratory welding operation shown in FIGS. 6 and 7, prior to the heat-welding of the film-shaped member 64 to the lower case 41, the ink-filled ink pack 24 is housed in the lower case 41 from above.

Subsequently, the ink outlet section 55 attached to the ink pack 24 is exposed outside the lower case 41 by way of the opening section 46 formed in the side end of the lower case 41. The O-ring 56 is sealingly retained with the annular engagement member 57, so that the ink outlet section 55 of the ink pack 24 is fixed to the opening section 46 of the lower case 41.

As partially shown in FIG. 9A, the weld surface 42 is continuously formed along the entire peripheral edge of the lower case 41 so as to be located on a substantially-flat single imaginary plane. The heat-welding film 64 is heat-welded to the continuous weld surface 42 formed along the peripheral edge of the lower case 41.

As shown in FIG. 9A, the peripheral edge of the lower case 41 is supported by a stationary jig 66.

The heat-welding film 64 is placed so as to cover the weld surface 42 formed along the peripheral edge of the lower case 41. In this state, a heater chip 67 is lowered from above to the weld surface 42 formed along the peripheral edge of the lower case 41, thereby bonding the heat-welding film 64 to the weld plane 42 by compression.

As a result, the heat-welding film 64 is welded to and hermetically bonded to the peripheral edge of the lower case 41.

The pressure chamber 25 can be hermetically formed within the lower case 41, by bonding the opening in the upper surface of the lower case 41 through use of the heat-welding film 64.

The heat-welding film 64 has a comparatively-flexible characteristic. Therefore, if the ink cartridge in this state is mounted to the recording apparatus, the heat-welding film 64 expands upon receipt of the pressurized air supplied from the air pressurization pump, and thus causes a technical problem in that the air pressure within the pressure chamber 25 defined by the lower case 41 and the heat-welding film 64 is unstable.

FIG. 9B shows a construction for solving such a problem. As shown in FIG. 9B, a reinforcement member 71 is provided for covering the heat-welding film 64 from above. An engagement section 71*a* which removably engages with the peripheral edge of the lower case 41 is formed integrally along the peripheral edge of the reinforcement member 71.

By this construction, even if the heat-welding film 64 attempts to expand as a result of pressurized air being supplied to the pressure chamber 25 defined by the lower case 41 and the heat-welding film 64, the heat-welding film 64 comes into contact with the surface of the reinforcement member 71, thus preventing expansion of the heat-welding film 64.

Even in such an ink cartridge having the above-described construction, a pressure chamber can be formed between the lower case 41 and the heat-welding film 64. The ink cartridge can be preferably adopted for use with an ink-jet recording apparatus constructed so as to introduce pressurized air into ink cartridges as mentioned above.

Figure 10:
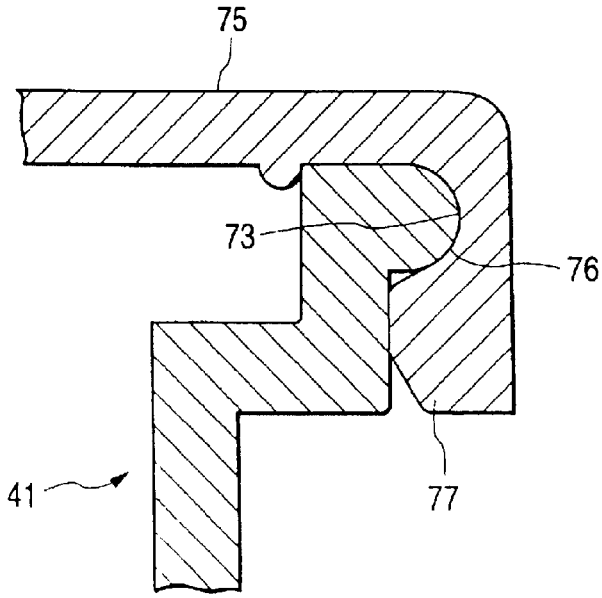
FIG. 10 is a schematic representation showing that a contact surface formed on a cover member is hermetically attached to a counterpart contact surface formed on the lower case, thereby maintaining a sealed state.

FIG. 10 is a schematic representation showing another modification for constructing the ink cartridge.

In the modification shown in FIG. 10, a closely contactable, continuous surface is formed on the cover constituting the second outer shell constituent member, and a mating closely contactable continuous surface is formed on the case constituting the first outer shell constituent member to be closely contacted with the former contactable surface, thereby maintaining the hermetically sealed state of the cover and case.

As the end of the lower case and the end of the cover are shown in cross section in FIG. 10, an arcuate mating contact surface 73 is formed projectingly along the entire peripheral edge of the lower case 41 serving as the first constituent outer shell member.

An arcuate contact surface 76 to come into close contact with the mating contact surface 73 formed along the peripheral edge of the lower case 41 is formed in a recessed manner in the peripheral edge of a cover 75 serving as the second outer shell constituent member.

An engagement section 77 which removably engages with the peripheral edge of the lower case 41 is formed integrally on the cover 75. By the action of the engagement section 77, the case 41 and the cover 75 maintain a hermetic state.

Even in an ink cartridge having such a construction, a pressure chamber can be formed between the lower case 41 and the cover 75. Accordingly, the ink cartridge can be preferably adopted for use with an ink-jet recording apparatus constructed so as to introduce pressurized air into ink cartridges as mentioned above.

Even in the case of the construction shown in FIG. 10, an ink pack preliminarily filled with ink is inserted into the lower case 41 acting as the first outer shell constituent member. In this state, the cover 75 acting as the second outer shell constituent member is placed on top of the case 41, in the same manner as has been described in connection with the embodiment including the modification.

As is evident from the foregoing description, in the ink cartridge according to the first embodiment, an ink pack is housed in the ink cartridge, and an outer shell member of the ink cartridge is constructed such that at least first and second outer shell constituent members are hermetically joined together. Therefore, to form an ink cartridge product, the first and second outer shell constituent members can be joined together in a state in which an ink-filled ink pack has been installed.

Since the first and second outer shell constituent members are joined together hermetically, disassembly and recycling of a waste cartridge are facilitated, thereby contributing to conservation of resources.

Second Embodiment

Next will be described an ink cartridge according to the second embodiment of the present invention. The ink cartridge according to the present embodiment is featured in that, when the ink cartridge is removed from the recording apparatus, the pressurized air inlet port formed in the cartridge is released, thereby immediately bringing a pressure chamber formed between the outer shell member of the ink cartridge and the ink pack in communication with the atmosphere.

Figure 11:
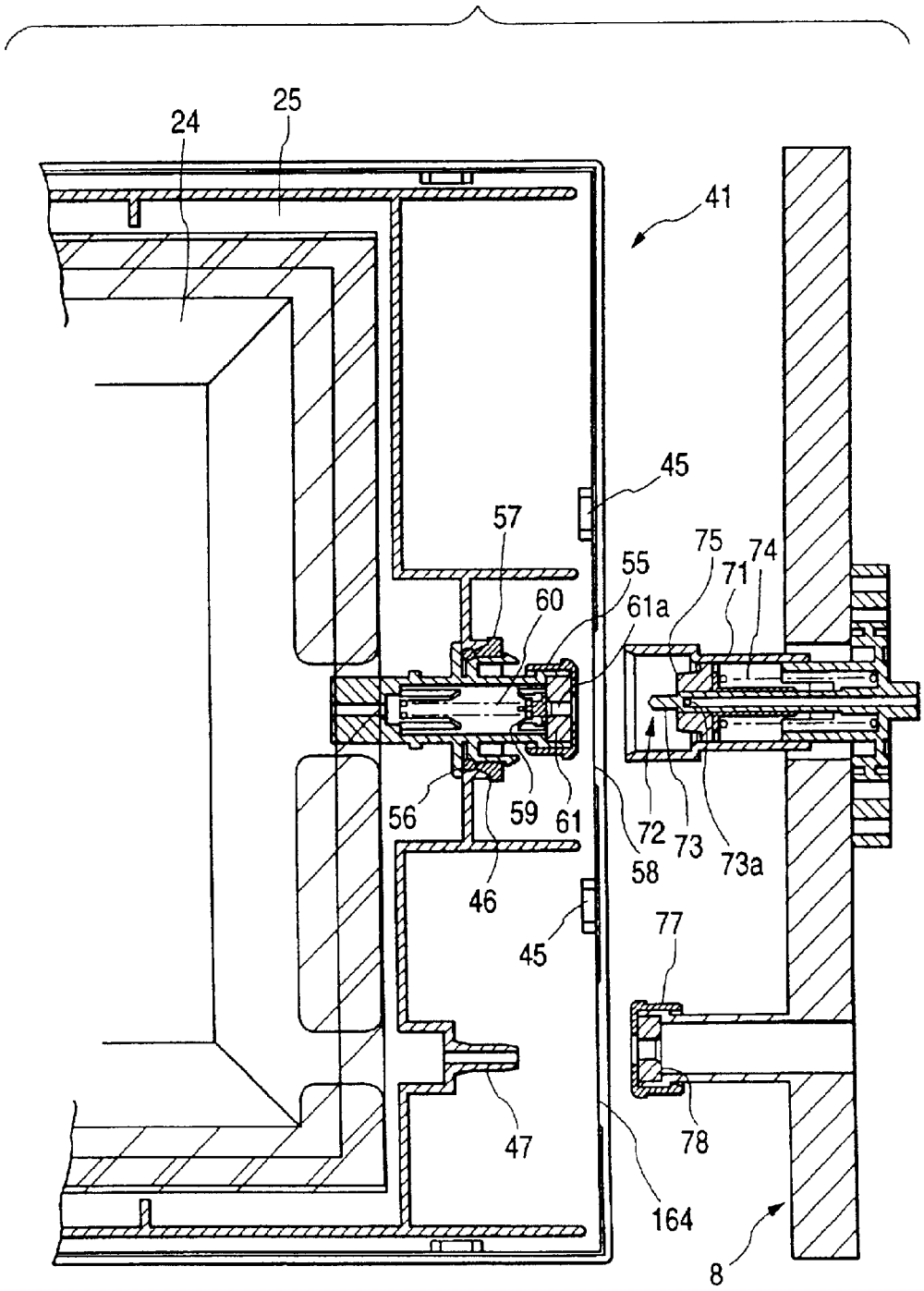
FIG. 11 is a cross-sectional view showing a state in which an ink cartridge is removed from a cartridge holder of a recording apparatus.
Figure 12:
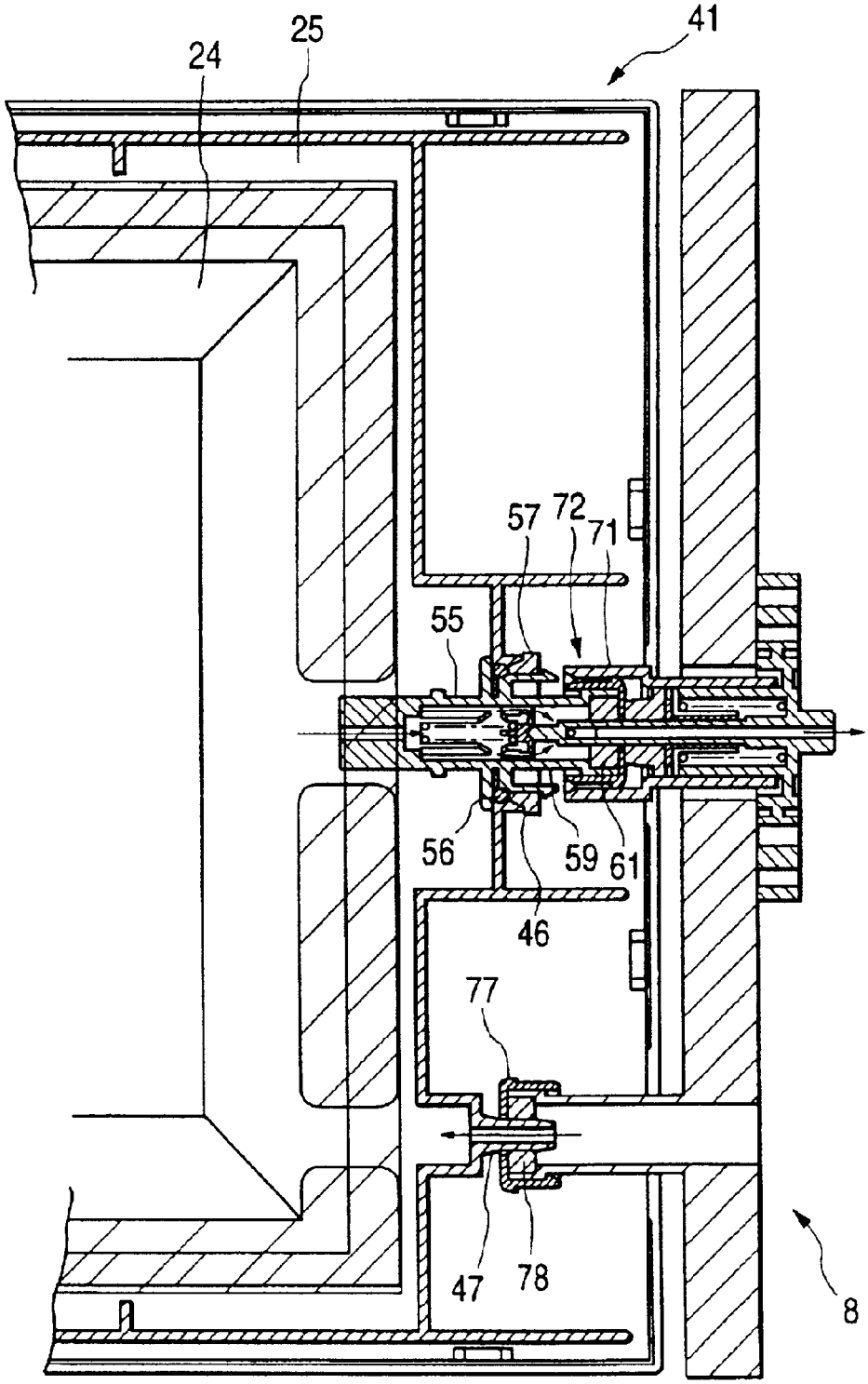
FIG. 12 is a cross-sectional view showing a state in which the ink cartridge is attached to the cartridge holder.

An opening section 58 is formed in the front end of the lower case 41 having the ink outlet section 55 formed therein in the manner as mentioned previously. When the ink cartridge is loaded into the cartridge holder 8, an ink receive connection section—which will be described later and is provided on the cartridge holder 8—enters the opening section 58, as shown in FIGS. 11 and 12. Accordingly, the ink outlet section 55 provided in the ink cartridge can be connected to the ink receive connection section provided in the cartridge holder 8.

The ink outlet section 55 is equipped with a valve member 59 which axially retracts upon contact with a connection section of the cartridge holder 8 to be described later, to thereby become open. The valve member 59 is urged by a spring member 60 to advance axially.

The valve member 59 urged by the spring member 60 so as to advance in the axial direction is pressed against an annular packing member 61 having a through hole 61*a* formed in the center thereof. Consequently, the ink outlet section 55 is closed, as shown in FIG. 11.

The pressurized air inlet port 47 formed in the lower case 41, the case constituting the outer shell of the ink cartridge, is formed as a cylindrical member which defines an air channel communicating with the pressure chamber 25. The cylindrical member is integral with the lower case 41, and protrudes toward the front end section of the cartridge.

An opening section 164 is formed in the area on the front end section of the lower case 41 corresponding to the pressurized air inlet port 47. As shown in FIG. 12, when the ink cartridge is loaded into the cartridge holder 8, a pressurized air supply section formed in the cartridge holder 8 relatively enters the opening section 77 so that a packing member provided in the pressurized air supply section comes into close contact with and is coupled to the outer peripheral surface of the pressurized air inlet port 47.

An ink receive connection section 71 is projectingly formed in the center of the cartridge holder 8.

An open/close valve unit 72 is provided in the connection section 71. When the ink cartridge is loaded in the cartridge holder 8, the open/close valve unit 72 retracts axially upon contact with the ink outlet section 55 of the ink cartridge, to thereby become open. When no ink cartridge is loaded in the cartridge holder 8, the open/close valve unit 72 advances in the axial direction and is maintained closed.

The open/close unit 72 is equipped with a hollow needle 73 having ink inlet holes 73*a* formed therein, and an annular slide member 75. The annular slide member 75 is slidably provided so as to surround the outer circumference of the hollow needle 73. When no ink cartridge is loaded in the cartridge holder 8, the annular slide member 75 moves to a position where it closes the ink inlet holes 73*a* formed in the hollow needle 73 upon receipt of urging force of a spring 74.

In the case shown in FIG. 11 where no ink cartridge is loaded in the cartridge holder 8, the annular slide member 75 advances upon receipt of urging force of the spring member 74, thereby closing the ink inlet holes 73*a* formed in the hollow needle 73.

In the case shown in FIG. 12 where an ink cartridge is loaded into the cartridge holder 8, the ink outlet section 55 comes into contact with the annular slide member 75, to thereby cause the slide member 75 to retract. As a result, the ink inlet holes 73*a* of the hollow needle 73 becomes exposed and open, to thereby permit inflow of ink.

Concurrently, the tip end of the hollow needle 73 of the cartridge holder 8 penetrates into the through hole 61*a* of the packing member 61 of the ink cartridge, to thereby come into contact with the valve member 59. As a result, the valve member 59 axially retracts, thus rendering the ink outlet section 55 of the ink cartridge open.

As designated by the arrow shown in FIG. 12, ink can be supplied from the ink cartridge to the cartridge holder 8.

Simultaneously, the pressurized air inlet port 47 constituting a pressurized air inlet port of the cartridge also enters the annular packing member 78 of the pressurized air supply section 77 provided in the cartridge holder 8.

The packing member 78 comes into close contact with and is coupled to the outer peripheral surface of the pressurized air inlet port 47. As designated by the arrow shown in FIG. 12, pressurized air can be introduced into the pressure chamber 25 of the cartridge.

When an ink cartridge is removed from the cartridge holder 8, the pressurized air inlet port 47 communicating with the pressure chamber 25 of the cartridge is released from a sealed state in which the inlet port 47 has been sealed by the packing member 78 of the pressurized air supply section 77 of the cartridge holder 8.

Accordingly, the pressure chamber 25 of the cartridge is immediately released to the atmosphere by way of the air channel of the pressurized air inlet port 47. Therefore, the ink pack 24 is also immediately released from a pressurized state.

The ink outlet section 55 of the ink cartridge is also closed, thereby preventing leakage of ink, which would otherwise be caused under force of gravity.

Concurrently, the ink receive connection section 71 of the cartridge holder 8 is also closed, thus preventing reverse flow of ink from the sub-tank 9.

As is evident from the foregoing descriptions, in the ink cartridge according to the second embodiment of the present invention, when an ink cartridge is removed from the recording apparatus, the pressurized air inlet port 47 formed in the cartridge is released, thereby immediately bringing the pressure chamber defined between the outer shell member of the cartridge and the ink pack 24 into communication with the atmosphere. Consequently, the ink pack 24 is immediately released from a pressurized state, thus preventing inadvertent gushing or leakage of ink from the ink pack 24.

The recording apparatus, to which the ink cartridge is to be loaded, is equipped with the open/close valve unit 72. Accordingly, when no ink cartridge is loaded in the cartridge holder 8, the open/close valve unit 72 axially advances and is maintained closed, thereby preventing a problem of contamination, which would otherwise be caused by reverse flow of ink from the sub-tank 9.

Third Embodiment

Figure 13:
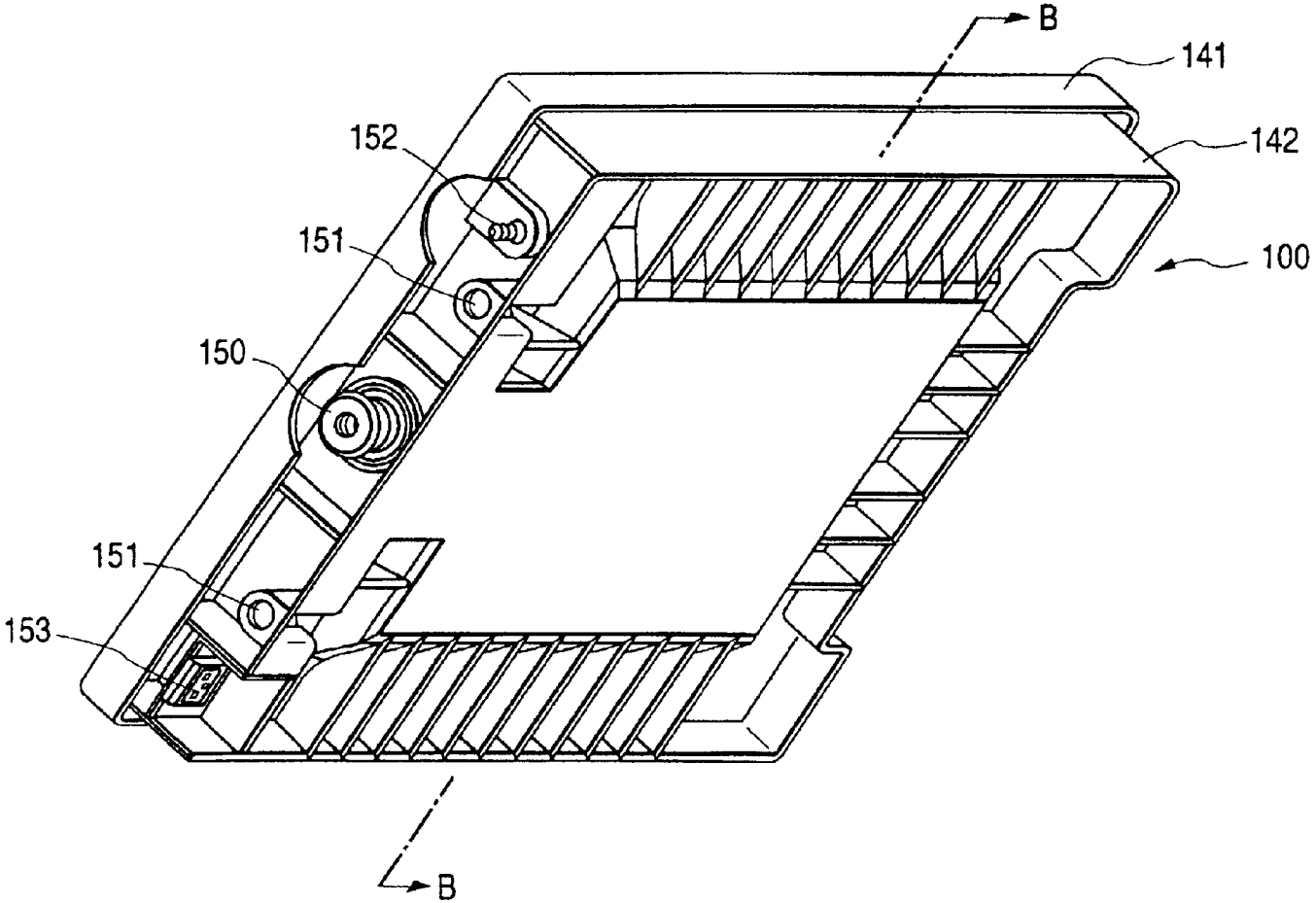
FIG. 13 is a perspective view showing the appearance and construction of the ink cartridge according to the present invention.
Figure 14:
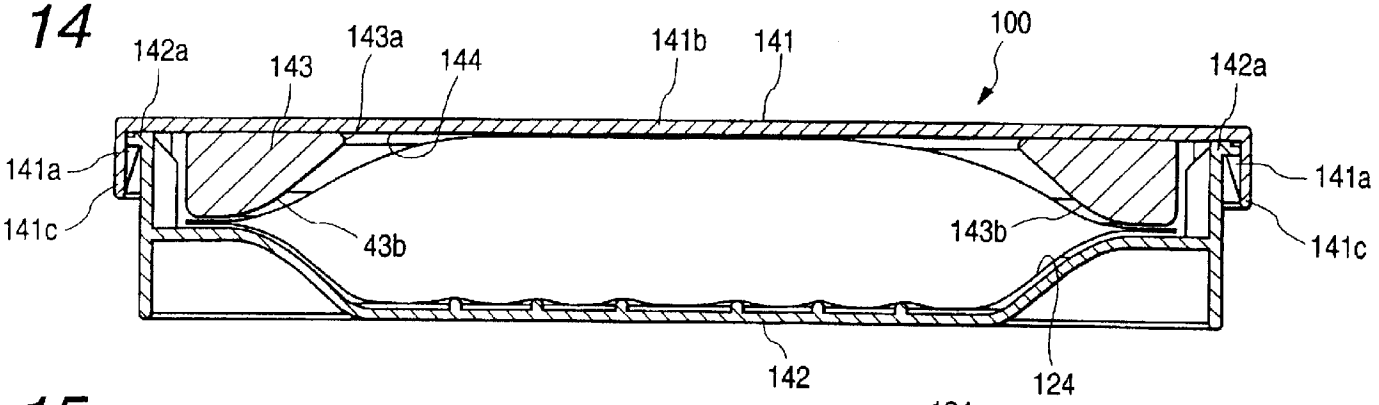
FIG. 14 is an enlarged cross-sectional view of the ink cartridge when viewed from line B—B shown in FIG. 13 in the direction designated by arrows.
Figure 15:
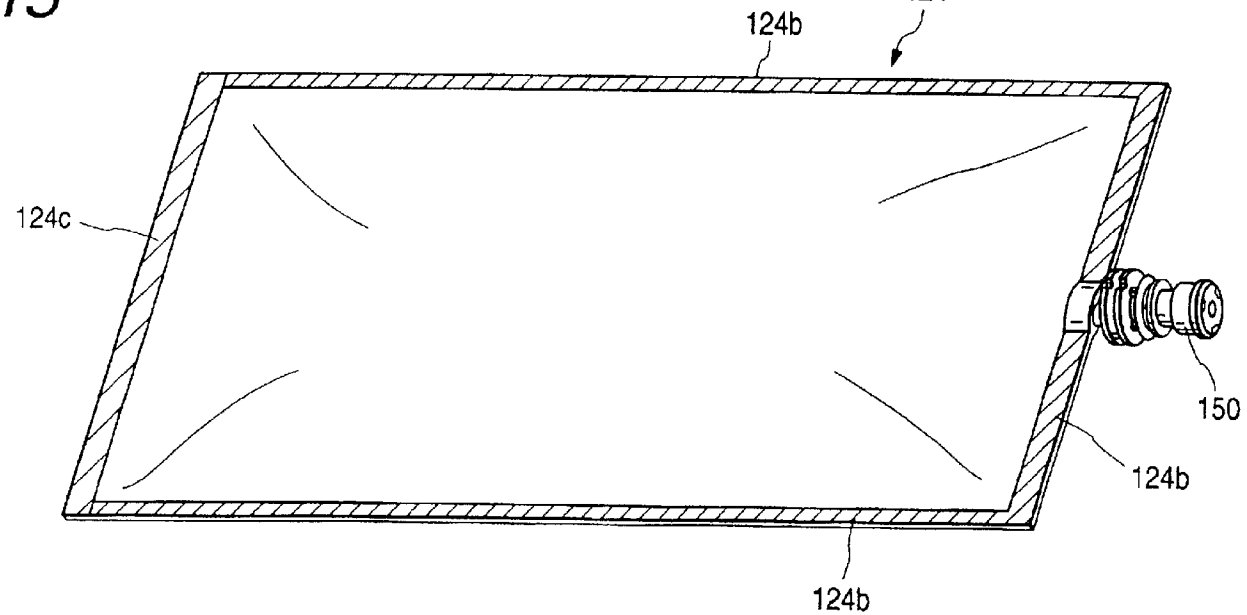
FIG. 15 is a perspective view showing the construction of an ink pack to be housed in the ink cartridge shown in FIG. 13.

An ink cartridge according to a third embodiment of the present invention will now be described. FIGS. 13 through 15 show an ink cartridge (main tank) 100 according to the third embodiment of the present invention. FIG. 13 is a perspective view showing the entire construction of a main tank. FIG. 14 is an enlarged cross-sectional view of the ink cartridge when viewed from line B—B shown in FIG. 13 in the direction designated by arrows. FIG. 15 is a perspective view showing the construction of an ink pack 124 housed in an outer shell case shown in FIG. 13.

As shown in FIGS. 13 and 14, the outer shell case is constructed by an upper case 141 acting as a second case (the second outer shell constituent member), and a lower case 142 acting as a first case (the first outer shell constituent member).

The lower case 142 is formed into a flattened box shape, and the upper side of the lower case 142 is open. An ink-filled ink pack 124 (see FIG. 15) can be housed in the lower case 142.

In the present embodiment, as shown in FIG. 14, in order to fix the four sides of the ink pack 124 housed in the lower case 142, a quadrilateral intermediate lid 143 which is formed from, for example, styrene foam, and whose center is opened as a window is inserted into the ink cartridge 100. As will be described in detail later, a film member 144 designated by a thick line is heat-welded to a flange section 142*a* formed along the marginal edge of the opening of the lower case 142, thereby hermetically closing the lower case 142.

The upper case 141 formed into a flattened box shape is fitted on the lower case 142.

The upper case 141 acts as a cover for preventing outward expansion of the film member 144, which would otherwise be caused when the film member 144 is exposed to pressurized air. The upper case 141 is constructed by a planar section 141*b* acting as the cover member, and a fold section 141*c* which is integrally formed with the planar section 141*b* and forms right angles with the planar section 141*b*.

Wedge-shaped lug members 141*a* are intermittently formed along the interior surface of the fold section 141*c*. As the upper case 141 is pushed on the lower case 142, the lug members 141*a* engage the flange section 142*a* formed along the marginal edge of the opening of the lower case 142, whereby the upper case 141 and the lower case 142 are coupled together.

When pressurized air is introduced into the lower case 142 sealed by the film member 144, the film member 144 is positioned so as to come into contact with the entire interior surface of the upper case 141, thus preventing outward expansion of the film member 144, which would otherwise be caused when the film member 144 receives pressurized air.

FIG. 15 shows the structure of the ink pack 124 housed in the outer shell case that is constructed in the manner as mentioned above.

Two sheets of rectangular flexible material; for example, a polyethylene film, are used for the ink pack 124. In order to improve the gas-barrier characteristic of the ink pack 124, aluminum foil or other metal foil, for example, is laminated on the surface of each film. An ink outlet section 150 constituting an ink outlet port is attached to substantially the center of one lateral side end section of the ink pack 124.

Three sides, i.e. the lateral side end section having the ink outlet section 150 and the longitudinal side end sections orthogonal to the lateral side end section, are first joined by heat welding to form a bag. Reference numeral 124*b* designates a heat-welded section in each of the three sides.

Ink is filled into the ink pack 124 from the remaining one open side of the ink pack 124 formed into the bag. The remaining side is then joined by heat welding to provide the ink pack 124 sealing storing ink therein. Reference numeral 124*c* designates a heat-welded section in the remaining side.

Figure 16:
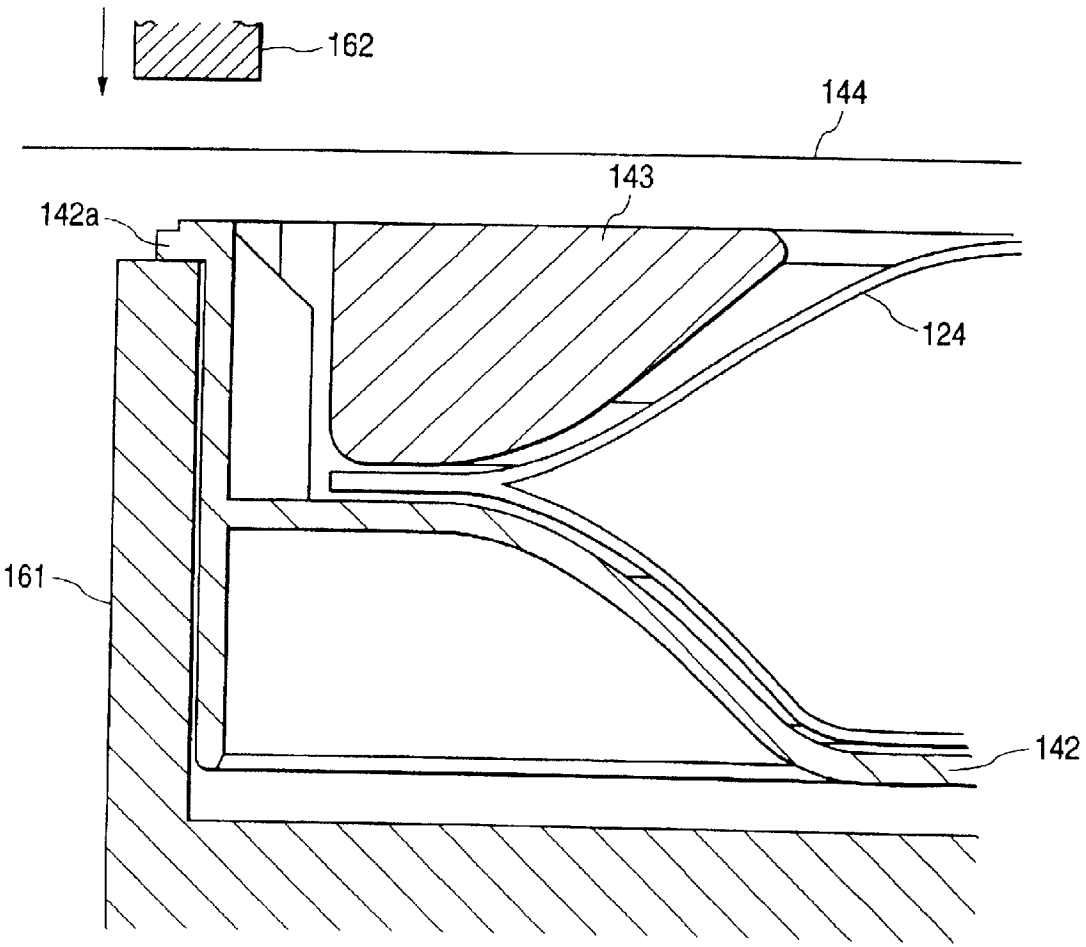
FIG. 16 is a partially-enlarged cross-sectional view showing a state in which the ink pack is sealed in the lower case by means of a film member.

FIG. 16 is a fragmentary enlarged view showing how to seal the ink pack 124 in the lower case 142 by the film member 144. First of all, the lower case 142 is placed on a stationary jig 161 using the flange section 142*a* formed along the marginal edge of the opening of the lower case 142.

The ink pack 124 is housed in the lower case 142, and then the quadrilateral intermediate lid 143 whose center is opened as a window is inserted into the lower case 142 to press and hold the four sides of the ink pack 124.

In this state, the film member 144 is located so as to cover the flange section 142*a* formed along the marginal edge of the opening of the lower case 142.

Subsequently, a heater head 162 formed having a flat surface similar in shape to a flat surface of the flange section 142*a* of the lower case 142 is lowered, thereby heating the film member 144 covering the flange section 142*a*. As a result, the film member 144 is heat-welded on and along the flange section 142*a* of the lower case 142, and the lower case 142 is hermetically sealed with the film member 144.

Figure 17:
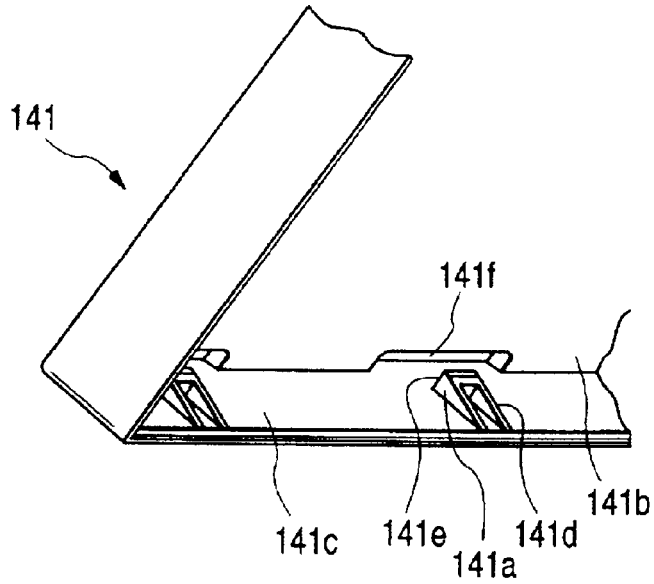
FIG. 17 is a perspective view of the corner section of the upper case when viewed from the interior surface of the corner section.
Figure 18:
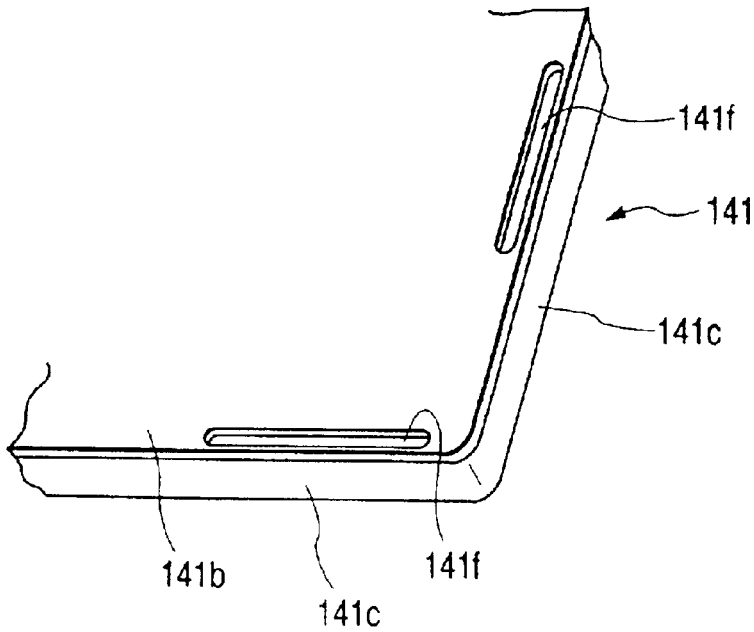
FIG. 18 is a perspective view of the corner section of the upper case when viewed from the top.

FIGS. 17 and 18 are enlarged views showing the construction of portions of the upper case 141 to be attached to the lower case 142 sealed with the film member 144 in the manner as mentioned above. Particularly, the lug members 141*a* intermittently formed on the interior surface of the fold section 141*c* of the upper case 141 and the surroundings of the lug members 141*a* are shown in an enlarged manner.

FIG. 17 is a perspective view of the corner section of the upper case 141 when viewed from the interior surface of the corner section, and FIG. 18 is a perspective view of the corner section of the upper case 141 when viewed from the top.

As shown in FIG. 17, a tapered surface 141*d* is formed on the lug member 141*a* so as to gradually increase in thickness from the lower end of the fold section 141*c* to the planar section 141*b* acting as a cover. An engagement step section 141*e* is formed on the end of the tapered surface 141*d* opposing the planar section 141*b*.

As shown in FIG. 18, slit holes 141*f* are formed through the planar section 141*b* of the upper case 141 to correspond in location to the lug members 141*a* and to be elongated along the fold section 141*c*.

The upper case 141 is laid on and forced to the lower case 142, so that the tapered surface 141*d* on each of the lug members 141*a* comes into slidable contact with the side surface of the flange section 142*a* formed along the marginal edge of the opening of the lower case 142.

As the upper case 141 is pushed further toward the lower case 142, the lug members 141*a* go beyond the flange section 142*a* formed on the lower case 142. Consequently, the flange section 142*a* of the lower case 142 is fitted into the engagement steps 141*e* of the lug members 141*a*, whereby the upper case 141 and the lower case 142 are attached together.

In this case, since the slit holes 141*f* are formed through the planar section 141*b* of the upper case 141 and along the fold section 141*c* thereof to correspond in location to the lug members 141*a*, the fold section 141*c* having the lug members 141*a* can be improved in terms of ease of flexure.

The ease of flexure of the fold section 141*c* effectively acts to provide relief when the tapered surface 141*d* of each of the lug members 141*a* goes beyond the flange section 142*a* of the lower case 142.

The provision of such relief is effective to avoid, for example, a problem of whitening of the area in which the lug members 141*a* are formed or a problem of cracks, which would otherwise be caused when undue stress acts on the lug members 141*a* when the upper and lower cases, both being made of synthetic resin, are attached together.

Figure 19:
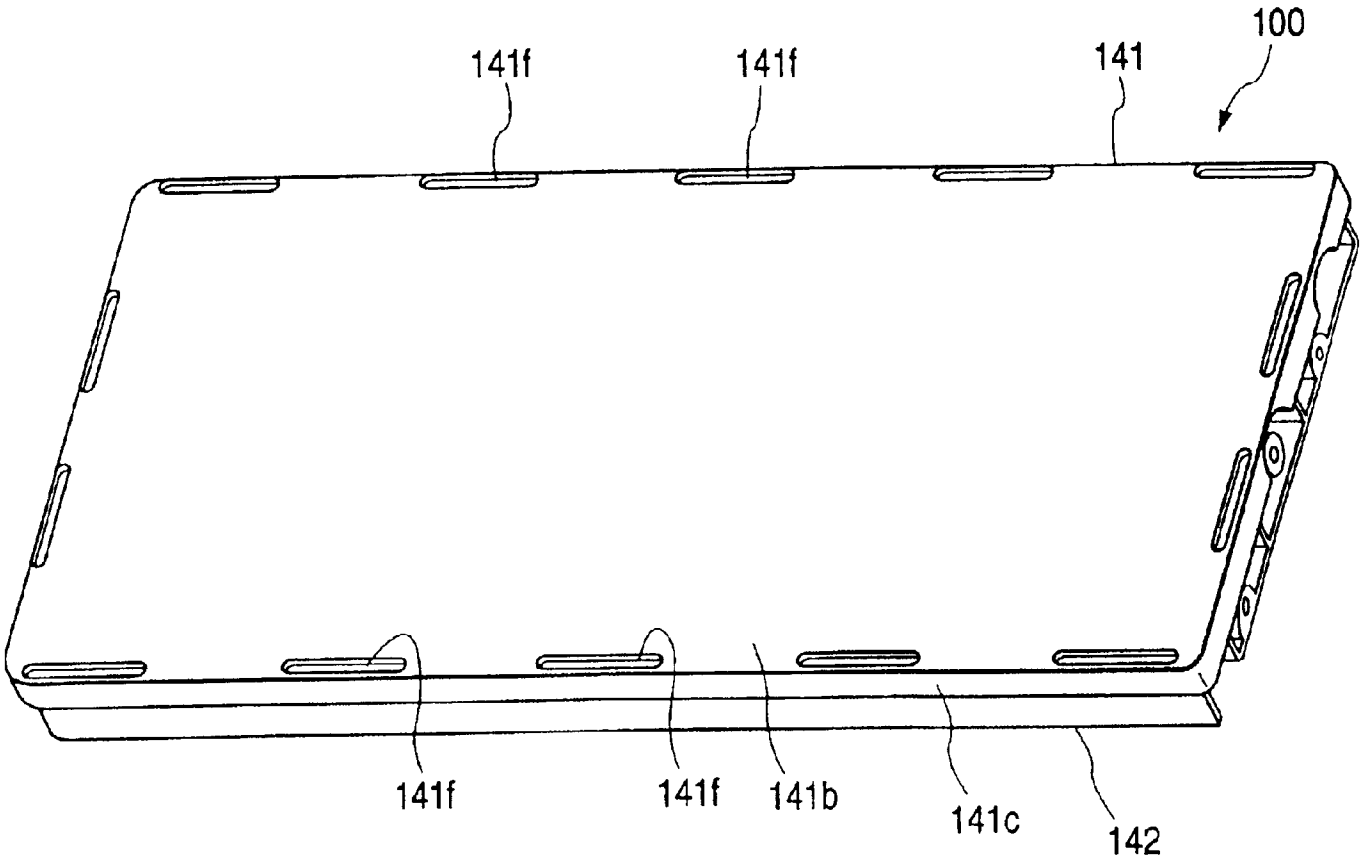
FIG. 19 is a perspective view of the entire ink cartridge when viewed from an upper case thereof.

FIG. 19 is a perspective view showing the entirety of the main ink tank 100 serving as the ink cartridge constructed in the manner as mentioned above, when viewed from above the upper case thereof.

In the present embodiment, five slit holes 141*f* are formed in either longitudinal side of the upper case 141. Similarly, the lug members 141*a* are provided at uniform intervals so as to correspond to the slit holes 141*f*. Moreover, two slit holes 141*f* are formed in either lateral side of the upper case 141. Similarly, the lug members 141*a* are also provided so as to correspond to the slit holes 141*f*.

In the main tank 100, i.e. the ink cartridge, as mentioned above, as shown in FIG. 13, a pair of open holes 151 to be utilized as positioning means at the time of loading the ink cartridge into the recording apparatus are formed in one surface of the cartridge case.

The pair of opening holes 151 are spaced apart from each other along a longitudinal direction of the one surface of the lower case 142. When the lower case 142 is formed by, for example, injection molding, the opening holes 151 are molded integrally and simultaneously with the lower case 142.

The ink outlet section 150 constituting an ink outlet port for the ink pack is attached to a substantially middle position between the positioning opening holes 151 thus disposed at two locations. A pressurized air inlet port 152 and a circuit board 153 to be described in detail later are provided outside the two opening holes 151.

Simultaneous with molding of the lower case 142, the pressurized air inlet port 152 is molded hollowly and integrally with the lower case 142. Pressurized air can be introduced into the lower case 142 sealed by the film member 144, by way of the pressurized air inlet port 152.

Figure 20:
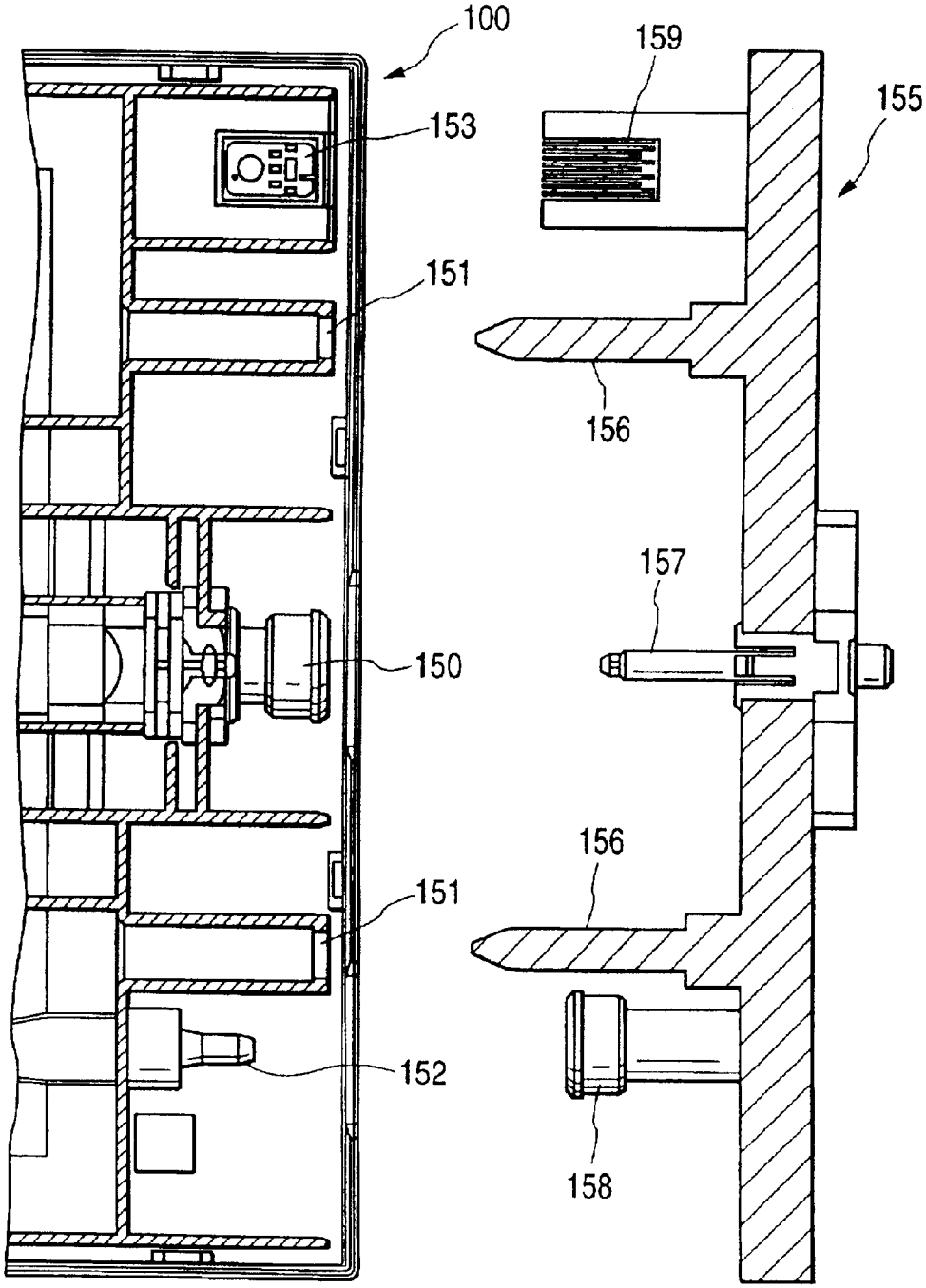
FIG. 20 is a cross-sectional view showing the end section on one side of the ink cartridge and the construction of a connection mechanism provided on the cartridge holder.

FIG. 20 shows the cross section of an end section on one surface of the main tank 100 that serves as the ink cartridge constructed in the manner mentioned above, showing that the main tank 100 is attached to a connection mechanism 155 provided on the cartridge holder 8 of the recording apparatus.

Figure 21:
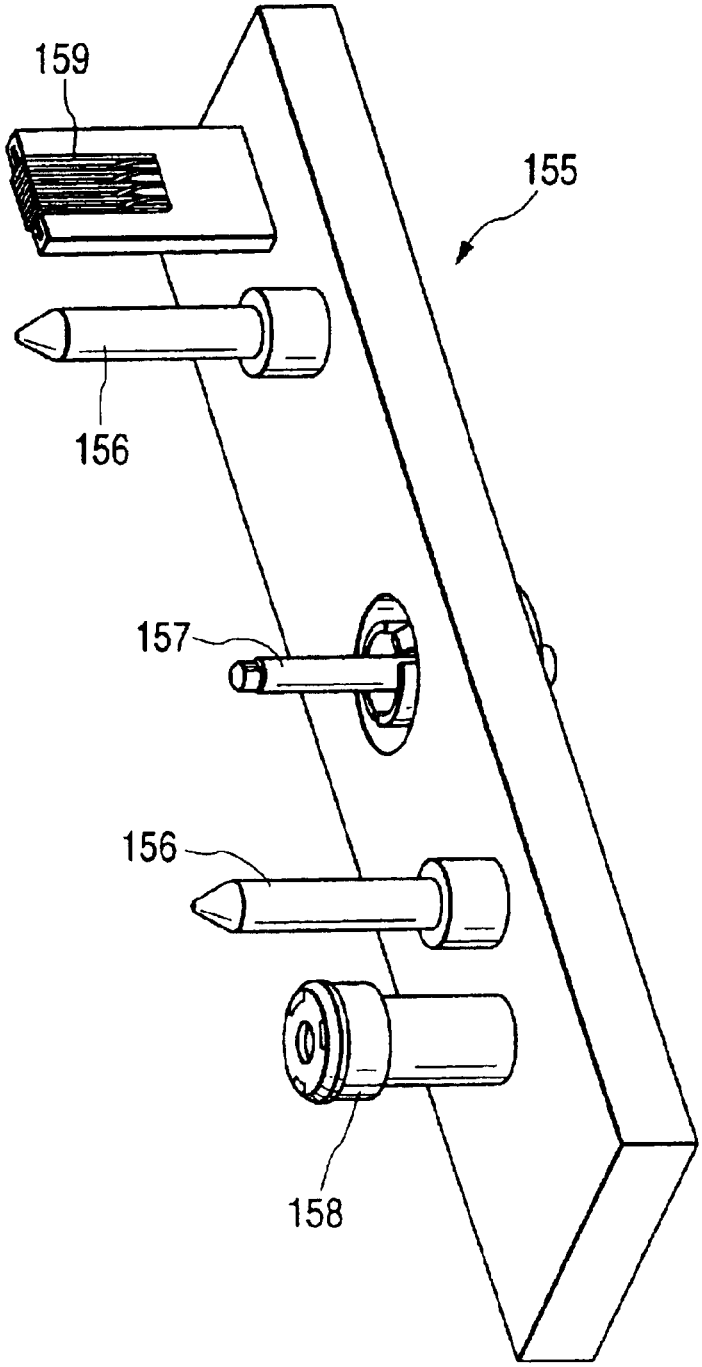
FIG. 21 is a perspective view showing the connection mechanism provided on the cartridge holder.

FIG. 21 is a perspective view showing the connection mechanism 155 provided on the cartridge holder 8.

As shown in FIGS. 20 and 21, a pair of columnar positioning pins 156 are formed on the cartridge holder 8. The positioning pins 156 are fitted into the pair of positioning opening holes 151 formed in the main tank 100, respectively.

The opening holes 151 are located at two positions in the longitudinal direction of the one surface of the lower case 142, and the two positioning pins 156 provided on the recording apparatus are fitted into the opening holes 151 until the base ends of the pins 156 come into contact with the opening holes 151. Accordingly, the main tank 100 serving as a cartridge can be positioned three-dimensionally.

As the positioning pins 156 are fitted into the main tank 100, a hollow ink outlet tube 157 provided in substantially the middle position between the pair of positioning pins 156 fits into the ink outlet section 150 attached to the ink pack 124, thereby enabling outflow of ink from the cartridge.

As a result of the main tank 100 being loaded onto the cartridge holder 8, the pressurized air inlet port 152 is connected to a pressurized air outlet port 158 formed in the holder 8, thus enabling introduction of pressurized air into the main tank 100.

A terminal mechanism 159 having a plurality of contacts is connected to the circuit board 153 mounted on the main tank 100, thereby enabling exchange of data with semiconductor storage means which is mounted on the circuit board 153 and is to be described later.

In a case where the main tank 100 is loaded onto the cartridge holder 8, the circuit board 153 mounted on the main tank 100 is arranged vertically and disposed at an upper position in the direction of gravity, as shown in FIG. 20.

Figure 22A:
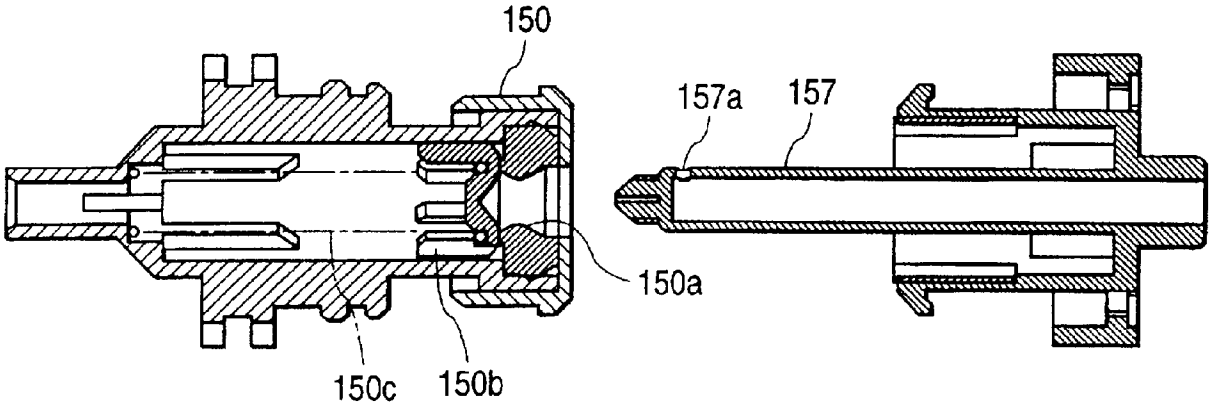
FIGS. 22A and 22B are cross-sectional views showing the construction of an ink outlet plug provided on the cartridge and the construction of an ink outlet pipe provided on the cartridge holder.
Figure 22B:
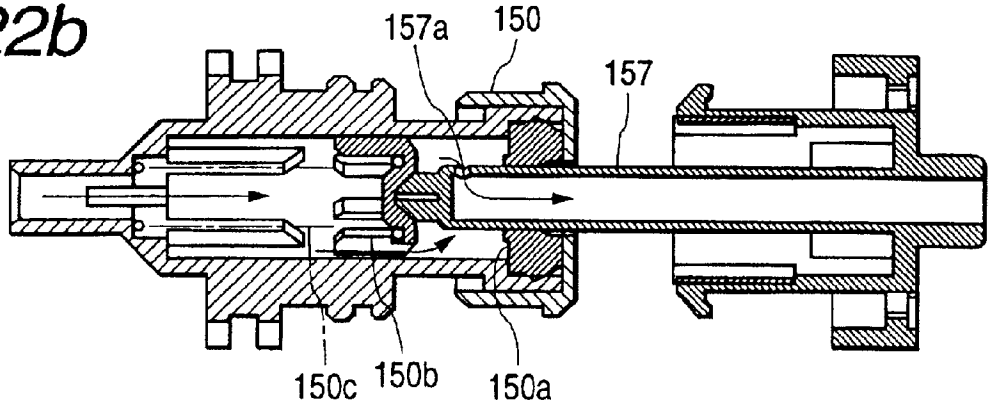

FIGS. 22A and 22B are cross-sectional views showing that the hollow ink outlet tube 157 provided in the holder 8 is inserted into the ink outlet section 150 provided on the ink pack 124 as a result of the main pack 100 being loaded to the cartridge holder 8, thereby enabling outflow of ink from the ink cartridge.

FIG. 22A shows the ink outlet section 150 and the ink outlet tube 157 before they are coupled, and FIG. 22B shows the ink outlet section 150 and the ink outlet tube 157 after coupling.

An annular rubber packing 150*a* is fitted into an exit section of the ink outlet section 150 provided in the ink pack 124. In contrast, a movable member 150*b* is housed in the ink outlet section 150 so as to enable axial movement.

The movable member 150*b* is constructed so as to close a central portion of the annular rubber packing 150*a* under the urging force of the coil-shaped spring member 150*c*. An opening 157*a* is formed in a position on the side surface in the vicinity of the tip end of the hollow ink outlet tube 157 provided in the holder 8.

In a state shown in FIG. 22A in which the main tank 100 acting as a cartridge is not loaded in the recording apparatus, the movable member 150*b* closes the center portion of the annular rubber packing 150*a* under the urging force of the coil-shaped spring member 150*c*, thereby preventing leakage of ink from the ink pack 124.

When the main ink tank 100 is loaded in the recording apparatus, the tip end of the ink outlet tube 157 pushes the movable member 15*b* inwardly against the urging force of the spring member 150*c*. Accordingly, an ink flow channel designated by arrows is formed, thereby enabling outflow of ink.

In this case, an annular internal-diameter portion of the rubber packing 150*a* comes into close contact with the outer diameter portion of the ink outlet pipe 157, thus preventing leakage of ink from the contact portion.

Figure 23:
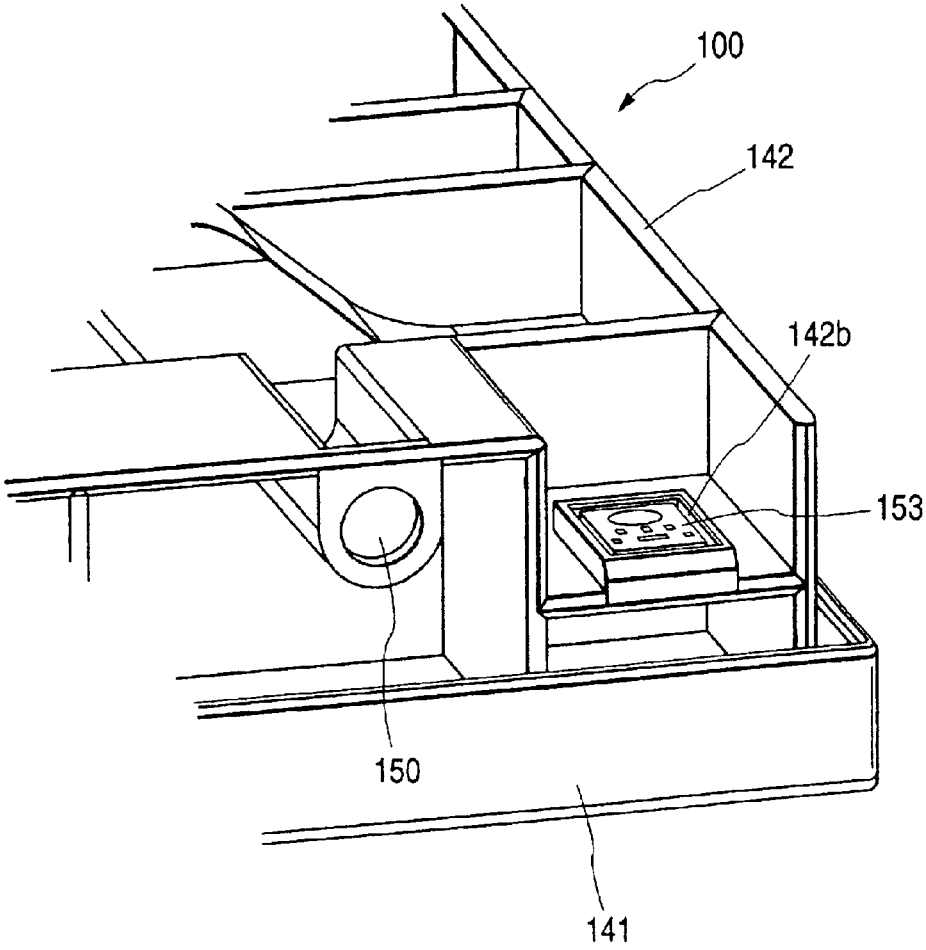
FIG. 23 is an enlarged view showing a circuit board mounted on the cartridge.
Figure 24B:
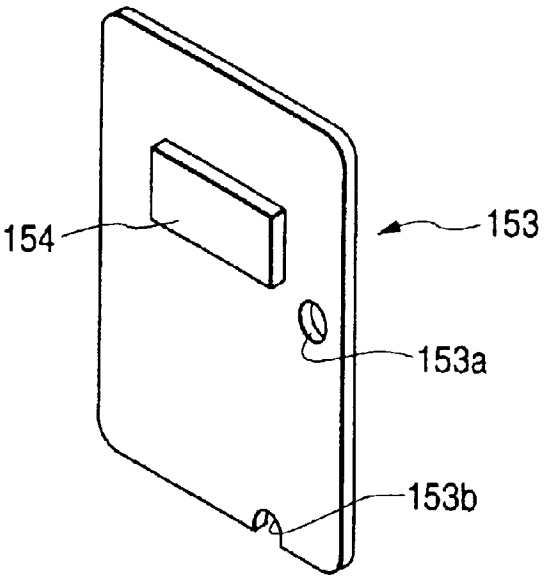
FIGS. 24A and 24B are perspective views showing the appearance and construction of the circuit board shown in FIG. 23 in a much enlarged manner.
Figure 24A:
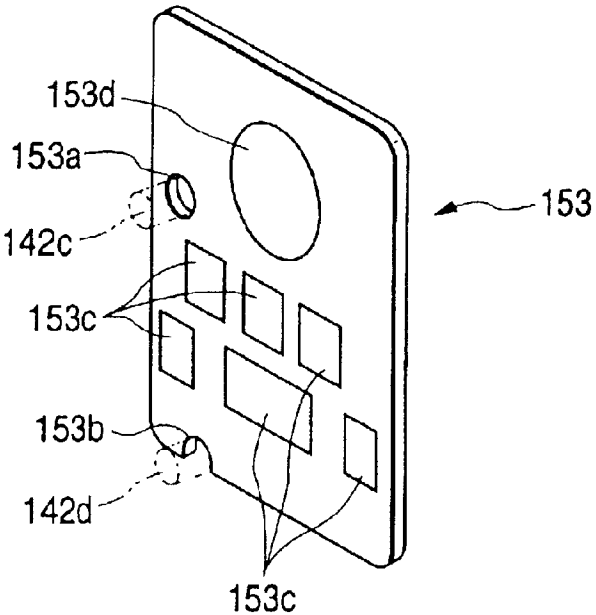

FIG. 23 shows the circuit board 153 mounted on the ink cartridge. FIGS. 24A and 24B show the appearance and construction of the circuit board 153. FIG. 24A is a perspective view of the circuit board 153 when viewed from the front, and FIG. 24B is a perspective view of the circuit board 153 when viewed from below the underside thereof.

As shown in FIG. 23, the circuit board 152 is located in the corner of the lower case 142 of the cartridge and is mounted on the inner bottom of a cubic space having two adjacent surfaces open. One of the two open surfaces enables connection between the circuit board 153 and the terminal mechanism 159 provided on the cartridge holder 8. The other of the two open surfaces is primarily used when the circuit board 153 is attached to the cartridge case.

As shown in FIGS. 24A and 24B, a through hole 153*a* and a notched hole 153*b* are formed in the circuit board 153 for mounting the circuit board 153 onto the lower case 142. As designated by phantom lines shown in FIG. 24A, protrusions 142*c* and 142*d* for heat-welding purposes to be inserted into the respective through hole 153*a* and the notched hole 153*b* are preliminarily formed on the lower case 142.

When the substantially-rectangular circuit board 153 is mounted on the lower case 142, the circuit board 153 is fitted into a recessed section 142*b* formed as shown in FIG. 23 for positioning the circuit board.

An unillustrated heater chip is brought into contact with the heads of the protrusions 142*c* and 142*d* designated by phantom lines shown in FIG. 24A, thus fusing the protrusions. As a result, the circuit board 153 is mounted on the lower case 142, as shown in FIG. 23.

The heater chip is used as a jig for mounting the circuit board 153 to the lower case 142, and the tip end of the heater chip is inserted into the upper open side of the cubic space in which the circuit board 153 is located.

As shown in FIG. 24A, electrode contacts 153*c* are formed on the front side of the circuit board 153 as connection terminals to be brought into electrical contact with the terminal mechanism 159 of the cartridge holder 8 when the main tank 100 is loaded in the cartridge holder 8.

An electrode contact 153*d* for checking purpose is formed in a circular shape on the same surface of the circuit board 153 on which the electrode contacts 153 are formed.

The electrode contacts 153*c* and 153*d* are connected to data-readable/writable semiconductor means 154 mounted on the underside of the circuit board 153. When the main tank 100 is loaded on the cartridge holder 8 of the recording apparatus, data pertaining to, for example, the type of ink stored in the main tank, an ink remaining amount, a serial number, and an expiration date, are sent and received between the main tank 100 and the recording apparatus.

The ink cartridge according to the third embodiment of the present invention is formed hermetically by the first and second cases 141 and 142, and an ink pack is housed in the ink cartridge. The lug members 141*a* formed on the second case 142 engage with the flange section 142*a* of the lower case 142, whereby the first case 141 and 142 are fixed together. Assembly and disassembly of an ink cartridge are readily achieved, thereby contributing to improving the ease of recycling of the constituent members of the ink cartridge.

In addition, the slit holes 141*f* are formed in positions on the planar section 141*b* corresponding to the lug members 141*a* along the fold section 141*c*, thereby improving the ease of flexure of the fold section 141*c* having the lug members 141*a*. This arrangement is effective to avoid, for example, a problem of whitening the area in which the lug members 141*a* are formed or a problem of cracks, which would otherwise be caused when undue stress acts on the lug members 141*a* when the upper and lower cases 141 and 142, both being made of synthetic resin, are attached together.

Fourth Embodiment

An ink cartridge according to a fourth embodiment of the present invention will now be described. The ink cartridge according to the present embodiment is equipped with an ink pack press member to be housed in a cartridge case along with an ink pack. The ink cartridge is featured in that, in accordance with the volume of the press member, the volume of ink sealingly stored in the ink pack can be adjusted.

Therefore, the constructions shown in FIGS. 13 through 24 can be adopted as preferable example constructions for the outer shell of the ink cartridge, the ink pack etc. in embodying the fourth embodiment.

Figure 25:
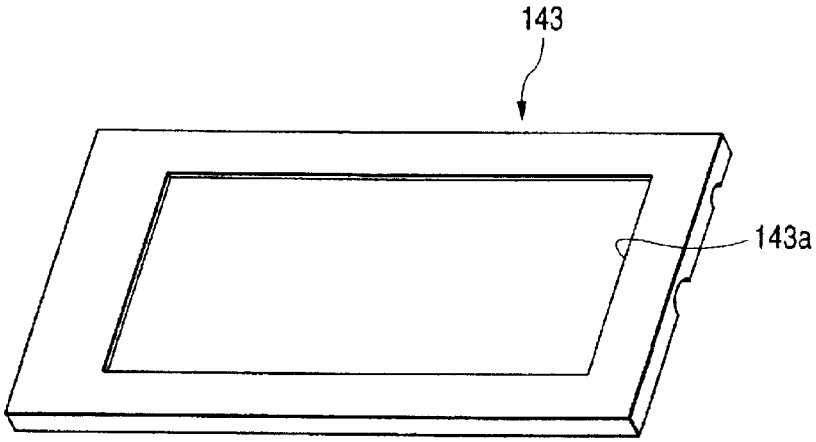
FIG. 25 is a perspective view showing the appearance and construction of a presser member housed in the cartridge along with the ink pack.
Figure 26A:
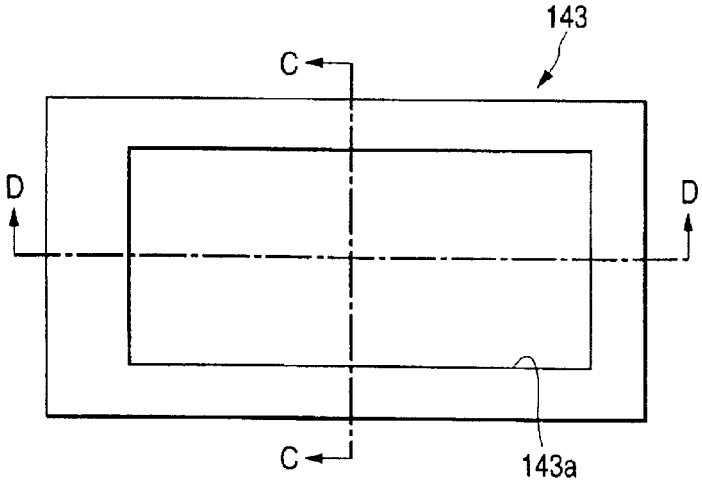
FIG. 26A is a front view showing the presser member shown in FIG. 25.
Figure 26B:
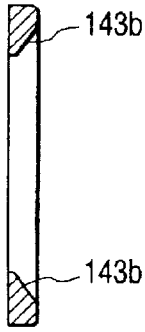
FIGS. 26B and 26C are cross-sectional views showing the presser member shown in FIG. 25.
Figure 26C:
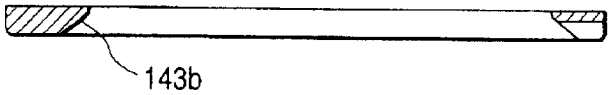

FIGS. 25 and 26 show the construction of the press member 143, and FIG. 25 is a perspective view showing the entirety of a press member. FIG. 26A is a front view showing the press member; FIG. 26B is a cross-sectional view of the press member when viewed from line C—C shown in FIG. 26A in the direction designated by arrows; and FIG. 26C is a cross-sectional view of the press member when viewed from line D—D shown in FIG. 26A in the direction designated by arrows.

As shown in FIGS. 25 and 26, the press member 143 is formed into a frame shape having a window-shaped opening 143*a* in the center of the press member 143. The press member 143 presses the four sealed sides of the rectangular ink pack 124.

As can be seen from the cross-sectional views shown in FIGS. 26B and 26C, the portion of the surface of the press member 143 opposing the four sides of the ink pack 124 is formed to have a tapered surface 143*b* which becomes gradually thinner toward the window-shaped opening 143*a* formed in the center of the press member 143.

As shown in FIG. 14, the tapered surface 143*b* is formed to be slightly curved. When the tapered surface 143*b* is contacted with the center of the ink pack 124 bulges as a result of ink being sealed therein, the tapered surface 143*b* thus slightly curved smoothly matches the geometry of the periphery of the ink pack 124.

When the ink pack 124 filled with a large amount of ink is housed in the lower case 142, the press member 143 of small volume is adopted, as shown in FIG. 14.

Figure 27:
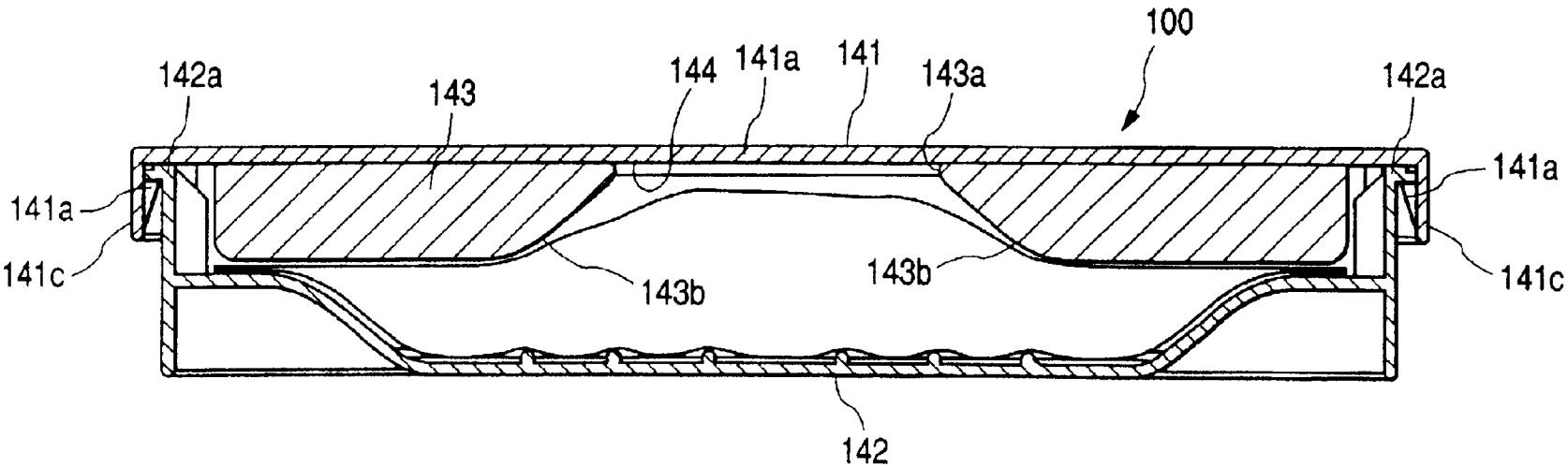
FIG. 27 is a cross-sectional view showing the cartridge when the ink pack filled with a small amount of ink is housed in the case along with the presser member.

When the ink pack 124 filled with a small amount of ink is housed in the lower case 142, the press member 143 of large volume is adopted, as shown in FIG. 27.

The press member 143 used with the main tank 100 shown in FIG. 27 has the central window-shaped opening 143*a* smaller in area than that shown in FIG. 14. Similarly, there is formed a tapered surface 143*b* which becomes gradually thinner toward the window-shaped opening 143*a*.

With this construction, the ink pack 124 filled with a small amount of ink is pressed by the press member 143, in areas of the four sides closer to the center of the ink pack 124.

In spite of an ink pack being filled with a small amount of ink, free movement of the ink pack within the ink cartridge can be effectively prevented. Consequently, it is possible to avoid a problem of damage to an ink pack, which would otherwise be caused when the ink pack is subjected to physical shock during transport.

As is evident from the foregoing descriptions, the ink cartridge according to the fourth embodiment of the present invention is equipped with an ink press member to be housed in a cartridge case along with an ink pack. In accordance with the volume of the press member, the volume of ink to be filled into the ink pack is adjusted. For example, so long as a plurality of types of press members are prepared preliminarily, a suitable press member may be selected in accordance with the volume of ink filed into an ink pack, and the thus-selected press member is housed in the cartridge case. Thereby, an ink pack can be housed in the cartridge case without a large clearance.

Consequently, the degree to which an ink pack will be damaged by physical shock stemming from transport can be decreased significantly.

In a case where the present invention is applied to an ink cartridge which introduces pressurized air into a cartridge case, the press member whose volume has been selected in accordance with the volume of ink filled in an ink pack is housed in the ink cartridge, and hence the volume of pressurized air to be introduced into the cartridge case can be regulated so as to fall within a predetermined range.

Consequently, even when a low-volume ink cartridge is used, there is no necessity for introducing a large amount of pressurized air into the cartridge case. Hence, there can be prevented a time lag that would arise from the time a recording apparatus is powered up to the time the recording apparatus enters a standby state, thereby improving throughput of the recording apparatus.

Other Embodiments

Finally, there will be described a preferred embodiment of a cartridge that can be applied to any one of the ink cartridges of the embodiments set forth, that can effectively prevent a problem of fracture of an ink pack, which would otherwise be caused by vibration or fall of an ink cartridge, and that has superior ease of recycling and enables recycling of not only a case constituting the outer shell but also an ink pack.

The preferred embodiment is featured in that a recessed section matching the cross section of a pillow-shaped ink pack filled with ink is formed on the interior surface of a hard case constituting the outer shell of an ink cartridge and that ribs capable of pinching the peripheral edge of the ink pack are formed.

More preferably, the preferred embodiment adopts an arrangement in which a plurality of ribs are formed in both lateral and longitudinal directions of the hard case, an arrangement in which projections and indentations are formed in the areas where the peripheral edge of an ink pack is pinched, and/or an arrangement in which through holes are formed in the peripheral edge of the ink pack, and protrusions are formed in the ribs so as to fit into the corresponding through holes.

Another preferred embodiment adopts an arrangement in which the geometry of the interior surface of the hard case matches the cross section of an ink-filled ink pack, and the peripheral edge of the ink pack is pinched by the hard case. In addition to this arrangement, the preferred embodiment adopts an arrangement in which projections and indentations are formed in the areas where the peripheral edge of an ink pack is pinched, and/or an arrangement in which through holes are formed in the peripheral edge, and protrusions to be inserted into the corresponding through holes are formed in the case.

Figure 28A:
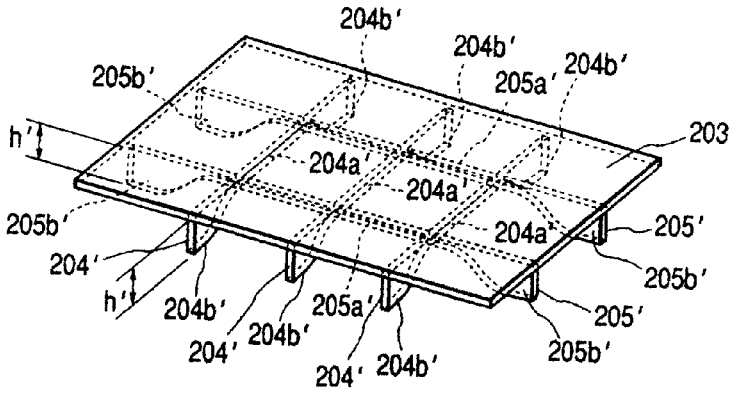
FIGS. 28A through 28C are exploded perspective views showing a preferred example of the ink cartridge according to the present invention.
Figure 28B:
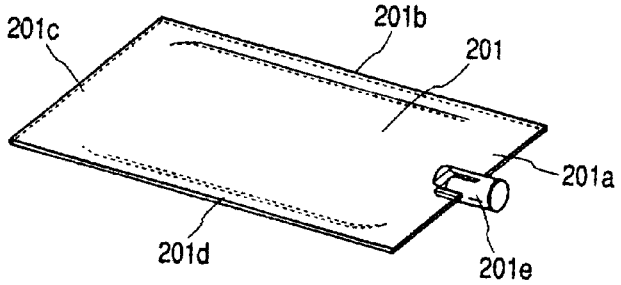
Figure 28C:
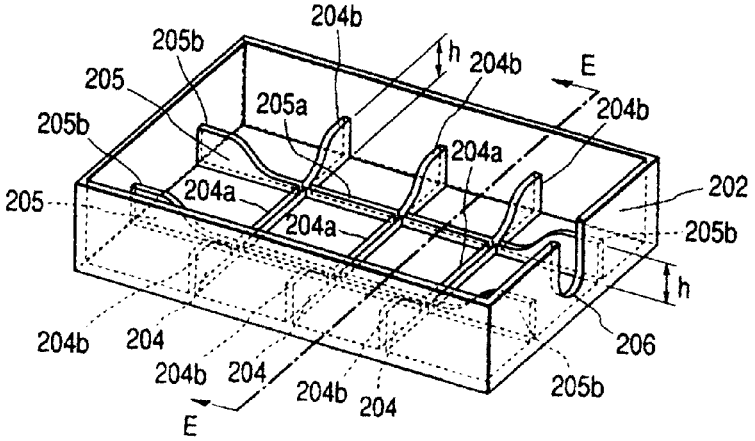

The preferred embodiments will be described more specifically by reference to the accompanying drawings. FIGS. 28A through 28C are exploded views showing a preferred example of an ink cartridge. A ink pack 201 is manufactured by preparing rectangular films, each made of a high polymer film and a high gas-barrier property material layer, such as a metal layer, on the surface of the polymer film, and heat-welding the rectangular films along peripheral edges 201*a*, 201*b*, 201*c*, and 201*d* of the ink pack 201 to form a bag while forming an ink supply port 201*e* in one side 201*a* of the ink pack 201.

The hard case housing the ink pack 201 is made up of two segments; that is, a box-shaped case main body (lower case) 202 and a cover (upper case) 203. Short ribs 204 for dividing the long sides 201*b* and 201*d* in equal lengths are formed on the plane of the lower case main body 202 which opposes the cover 203. Similarly, short ribs 204' for dividing the long sides 201*b* and 201*d* in equal lengths are formed on the plane of the cover 203 which opposes the lower case main body 202. Further, long ribs 205 are provided for dividing the short sides 201*a* and 201*c* in equal lengths are formed on the same plane of the lower case main body 202 on which the short ribs 204 are formed. Similarly, short ribs 205' are provided for dividing the short sides 201*a* and 201*c* in equal lengths are formed on the same plane of the cover 203 on which the short ribs 204' are formed.

Indentations 204*a* and 204*a*' are formed in the short ribs 204 and 204' so as to match the cross section of an ink-filled ink pack, and indentations 205*a* and 205*a*' are formed in the long ribs 205 and 205' so as to match the cross section of an ink-filled ink pack. End sections 204*b*, 204*b*', 205*b*, and 205*b*' of the ribs 204, 204', 205, and 205' opposing the peripheral edges 201*a*, 201*b*, 201*c*, and 201*d* of the ink pack 201 are set to heights h and h' so that the peripheral edges 201*a*, 201*b*, 201*c*, and 201*d* of the ink pack 201 can be sandwiched between the ribs 204, 204', 205, and 205' when the cover 203 is fixed on the case main body 202.

Reference numeral 206 shown in FIG. 28 designates a recess for constituting a window to be used for exposing the ink supply port 201*e* to the outside.

In this embodiment, the ink pack 201 filled with a specific volume of ink is placed on the case main body 202 such that the ink supply port 201*e* is located in the recess 206. As the cover 203 is fixed on the case main body 202, an ink-filled region of the ink pack 201 is supported by the indentations 204*a*, 204*a*', 205*a*, and 205*a*' of the ribs 204, 204', 205, and 205' without being subjected to the pressure imposed by the plane of the case main body 202 and the plane of the cover 203. Further, the peripheral edges 201*a*, 201*b*, 201*c*, and 201*d* are sandwiched between the end sections 204*b* and 204*b*' of the mutually-opposing ribs 204 and 204' and between the end sections 205*b* and 205*b*' of the mutually opposing ribs 205 and 205'.

Even if the ink pack 201 is subjected to vibration or physical shock in this state, the geometry of the ink pack 201 is defined by the indentations 204*a*, 204*a*', 205*a*, and 205*a*', and hence no great deformation arises in the ink pack 201.

The peripheral edges 201*a*, 201*b*, 201*c*, and 201*d* are sandwiched between the case main body 202 and the cover 203. Consequently, there can be prevented movement of an ink pack within the case, which would otherwise be caused by swaying action of ink. Moreover, there can be prevented fracture of an ink pack, which would otherwise be caused when the ink pack is subjected to great physical shock or pressure.

As the cover 203 is removed from the ink case after the ink stored in the ink cartridge has been consumed and the ink cartridge has been collected by a manufacturer, the ink pack 201 is released from a sandwiched state defined between the case main body 202 and the cover 203 and can be easily taken out of the ink cartridge.

The thus-removed ink pack is cleansed, and a wearout part, such as a packing of the ink supply port, is replaced with a new part. Then, the ink pack is refilled with ink.

The thus-refilled ink pack is placed in the case main body 202, and the cover 203 is fixed on the case main body 202 in the same manner as mentioned previously, thus completing a recycling process.

The above-mentioned embodiment eliminates a necessity for tearing and peeling an ink pack from an ink case, thereby enabling removal of an ink pack bag without inflicting damage, and implementing highly-reliable recycling of an ink cartridge.

Figure 29:
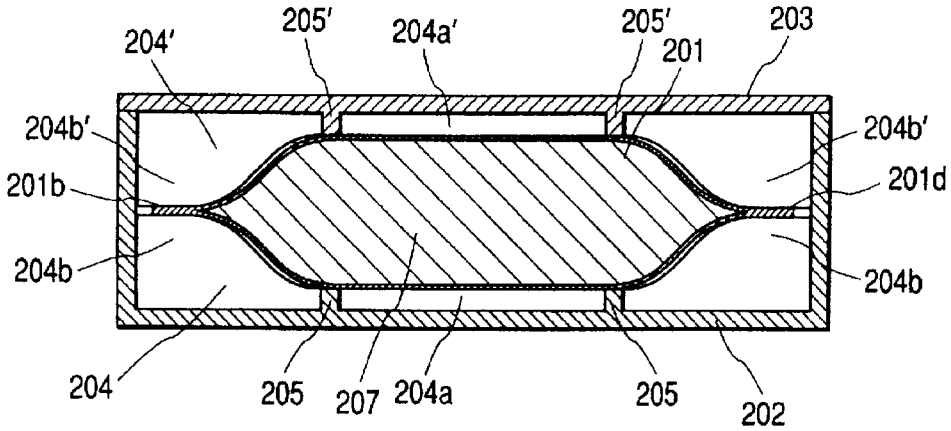
FIG. 29 is a cross-sectional view of the construction of the ink cartridge taken along line E—E shown in FIG. 28.

FIG. 29 is a cross-sectional view showing the structure of the case taken along line E—E shown in FIG. 28C. Indentations 204*a* are formed in ribs 204 provided on the case main body 202 so as to match the cross section of a pillow-shaped ink pack 201 filled with ink 207. Similarly, indentations 204*a*' are formed in ribs 204' provided on the cover 203 so as to match the same. The peripheral edges 201*b* and 201*d* of the ink pack 201 are sandwiched between end sections 204*b* and 204*b*' of the ribs 204 and 204'.

The ribs 204 and 204' regulate deformation of the ink pack 201 made of a flexible film, thus preventing deflection of the film at an acute angle.

Figure 30:
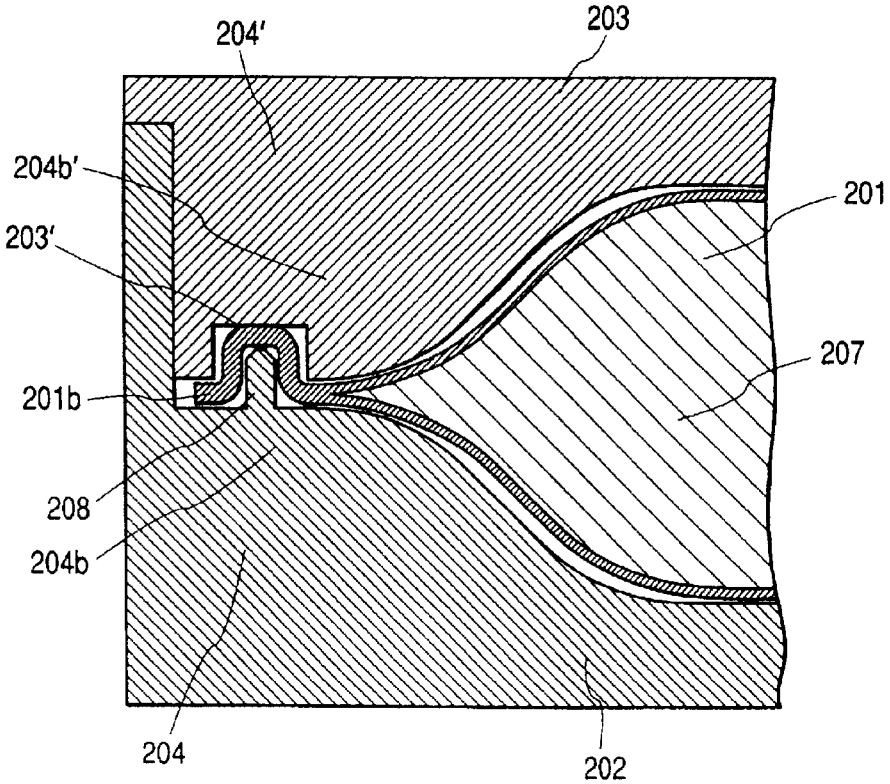
FIG. 30 is a cross-sectional view of another preferred example of the ink cartridge according to the present invention, showing a construction for fastening the periphery section of the ink pack.

FIG. 30 is a cross-sectional view showing another example structure for sandwiching the peripheral edge of an ink pack. As in the case of the embodiment shown in FIGS. 28A through 28C, the ribs 204 and 204' matching the contour of the ink pack 201 are formed on the lower case 202 and the cover 203. Moreover, a protuberance 208 is formed on each of the ends 204*b* for sandwiching the peripheral edge 201*b* of the ink pack 201, and a recess 208' is formed on each of the ends 204*b*' opposing the ends 204*b*. The protuberances 208 and the recesses 208' are formed in several locations along the peripheral edge of the ink pack 201.

The case main body 202 is housed in the ink pack 201, and the cover 203 is placed on the case main body 202 from above. As a result, the peripheral edge 201*b* of the ink pack 201 is sandwiched, in a clinched manner, between the protuberances 208 and the recesses 208'.

By sandwiching the peripheral edge of the ink pack 201 at several locations according to the method set forth, the ink pack 201 can be fixedly secured within the case. In this embodiment, the ink pack 201 can be easily taken out from the case upon removal of the cover 203. As in the case of the embodiment shown in FIGS. 28A through 28C, recycling of an ink cartridge can be performed readily.

Figure 31:
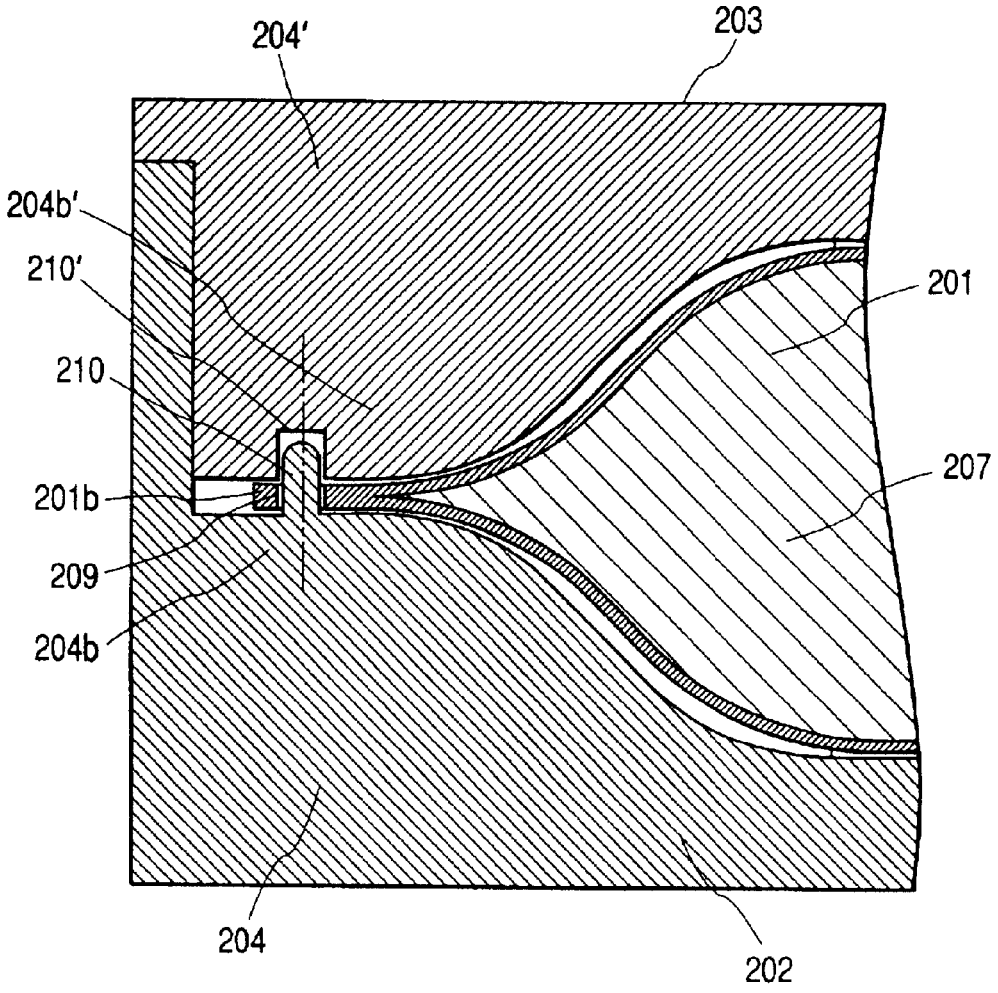
FIG. 31 is a cross-sectional view of still another preferred example of the ink cartridge according to the present invention, showing a construction for fastening the periphery section of the ink pack.

FIG. 31 is a cross-sectional view showing a construction for sandwiching the peripheral edge of an ink pack according to yet another preferred embodiment. A through hole 209 is formed in the peripheral edge 201*b* of the ink pack 201. As in the case of the embodiment shown in FIGS. 28A through 28C, the ribs 204 and 204' matching the contour of the ink pack 201 are formed on the lower case 202 and the cover 203. A protrusion 210 to be inserted into the through hole 209 is formed on the end section 204, and a hole 210' is formed in the end section 204' so as to correspond to the protrusion 210. The set including the through hole 209, the protrusion 210, and the hole 210' is formed in each of several locations on the peripheral edge of the ink pack 201.

The ink pack 201 is housed in the case main body 202 such that the protrusions 210 are inserted into the corresponding through holes 209. As the cover 203 is placed on the case main body 202 from above, the ink pack 201 is positioned and fixed by the through holes 209 and the protrusions 210. In the present embodiment, the ink pack 201 can be readily removed by taking off the cover 203. As in the case of the embodiment shown in FIGS. 28A through 28C, recycling of an ink cartridge can be readily performed.

Figure 32A:
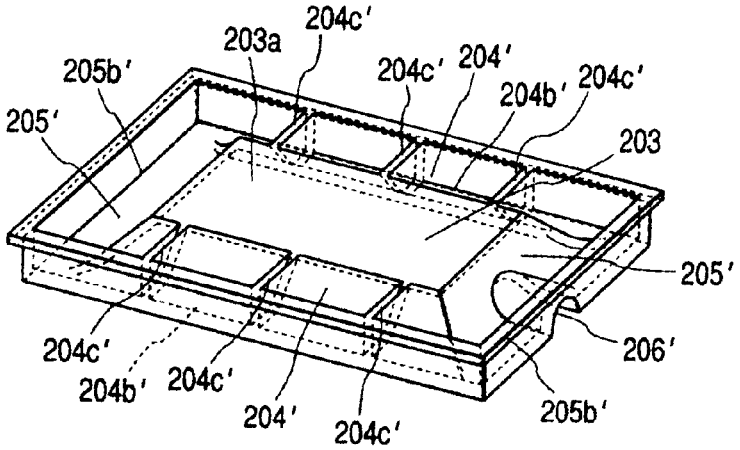
FIGS. 32A through 32C are perspective views of still another preferred example of the ink cartridge according to the present invention, showing a construction for fastening the periphery section of the ink pack.
Figure 32B:
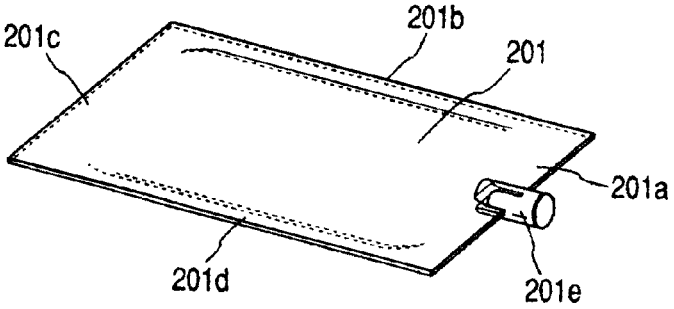
Figure 32C:
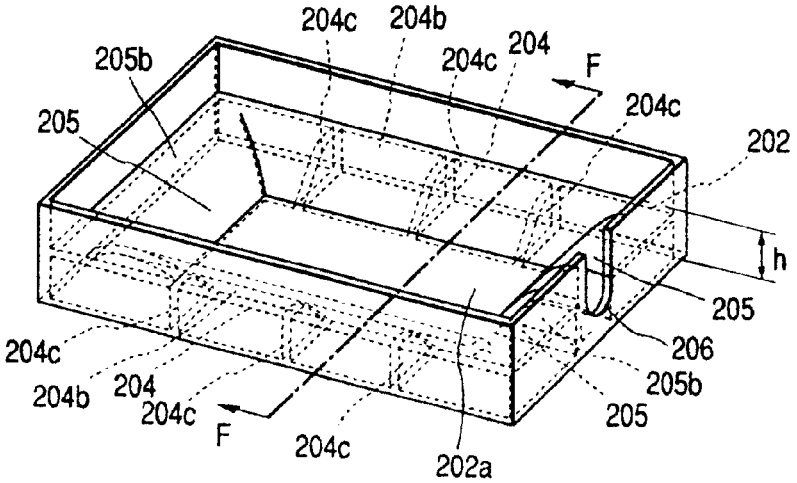

FIGS. 32A through 32C show an ink cartridge according to still another embodiment, in an exploded manner. The ink pack 201 is identical in structure with that shown in FIGS. 28A through 28C.

A hard case for housing the ink pack 201 is made up of two segments; that is, the box-shaped case main body 202 and the cover 203. Raised sections 204 and 205 are formed so that an interior surface 202*a* of the case main body 202 matches the cross section of a pillow-shaped ink-filled ink pack. Similarly, raised sections 204' and 205' are formed so that an interior surface 203*a* of the cover 203 matches the same.

End sections 204*b*, 204*b*', 205*b*, and 205*b*' of the raised sections 204, 204', 205, and 205' opposing the peripheral edges 201*a*, 201*b*, 201*c*, and 201*d* of the ink pack 201 are set to heights h and h' so that the peripheral edges 201*a*, 201*b*, 201*c*, and 201*d* of the ink pack 201 can be sandwiched between the raised sections 204, 204', 205, and 205' when the cover 203 is fixed on the case main body 202.

Recesses 206 and 206' are formed in the areas of the case main body 202 and the cover 203 where the ink supply port 201*e* is to be sandwiched. Ribs 204*c* and 204*c*' are formed on the back of the areas of the raised sections 204 and 204' with which the ink pack 201 is brought into contact, to thereby improve the rigidity of the raised sections 204 and 204'.

In the present embodiment, the ink pack 201 filled with a specified volume of ink is placed on the case main body 202 such that the ink supply port 201*e* comes to the recess 206. As the cover 203 is fixed, the ink-filled area of the ink pack 201 is supported by the interior surfaces 202*a* and 203*a* and the raised sections 204, 204', 205, and 205' from both sides without being subjected to pressure. The peripheral edges 201*a*, 201*b*, 201*c*, and 201*d* are supported by the opposing end sections 204*b*, 204*b*', 205*b*, and 205*b*'.

Even if the ink pack 201 is subjected to vibration or physical shock in this state, the geometry of the ink pack 201 is defined by the interior surfaces 202*a* and 203*a* of the case and by the raised sections 204, 204', 205, and 205', and hence no great deformation arises in the ink pack 201.

The peripheral edges 201*a*, 201*b*, 201*c*, and 201*d* are sandwiched between the end sections 204*b*, 204*b*', 205*b*, and 205*b*' Consequently, there can be prevented movement of an ink pack within the case, which would otherwise be caused by swaying action of ink. Moreover, there can be prevented fracture of an ink pack, which would otherwise be caused when the ink pack is subjected to great physical shock or pressure.

Figure 33:
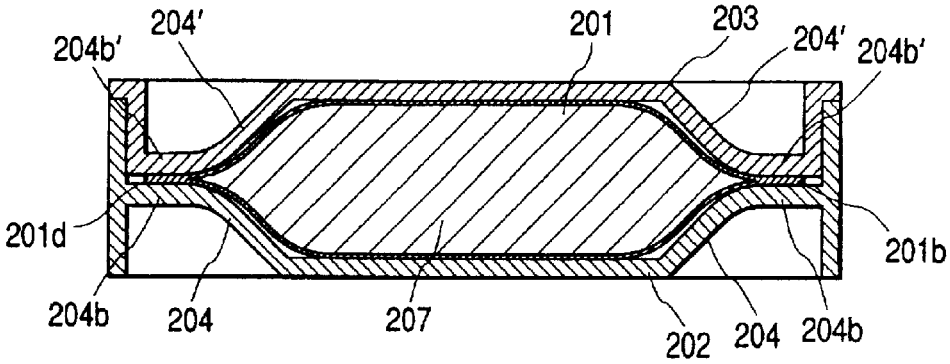
FIG. 33 is a cross-sectional view of the construction of the ink cartridge taken along line F—F shown in FIG. 32.

FIG. 33 is a cross-sectional view showing the structure of the case taken along line F—F shown in FIG. 32C. The raised sections 204 are formed on the case main body 202 so as to match the cross section of a pillow-shaped ink pack 201 filled with the ink 207. Similarly, the raised sections 204' are formed on the cover 203 so as to match the same. The peripheral edges 201*b* and 201*d* of the ink pack 201 are sandwiched between the mutually-opposing end sections 204*b* and 204*b'*.

Since the cross section of the case main body 202 and that of the cover 203 match the cross section of the ink pack 201, deformation in the ink pack 201 made of a flexible film is regulated, thus preventing deflection of the film at an acute angle.

Figure 34:
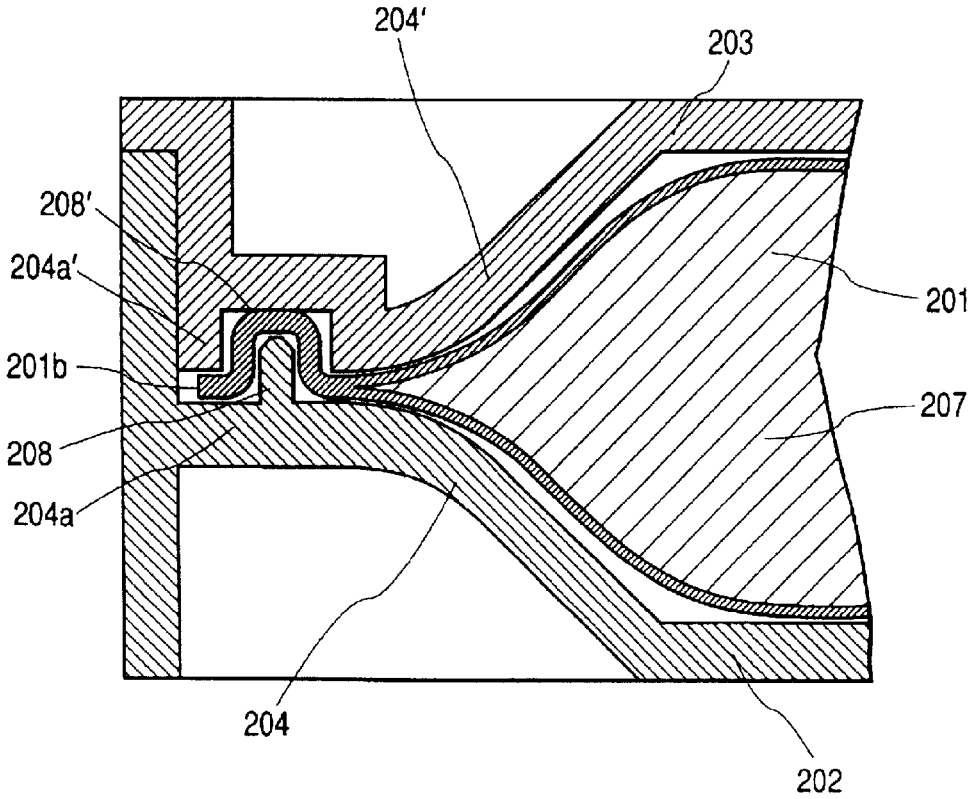
FIG. 34 is a cross-sectional view of yet another preferred example of the ink cartridge according to the present invention, showing a construction for fastening the periphery section of the ink pack.

FIG. 34 is a cross-sectional view showing another example structure of sandwiching the peripheral edge of an ink pack. The raised sections 204 and 204' are formed such that the cross section of the lower case 202 and that of the cover 203 match the cross section of the pillow-shaped ink pack 201 filled with the ink 207. Moreover, the protuberance 208 is formed on each of the ends 204*b* for sandwiching the peripheral edge 201*b* of the ink pack 201, and the recess 208' is formed in each of the ends 204*b*' opposing the ends 204*b*. The protuberances 208 and the recesses 208' are formed in each of several locations along the peripheral edge of the ink pack 201.

The ink pack 201 is housed in the case main body 202, and the cover 203 is placed on the case main body 202 from above. As a result, the peripheral edge 201*b* of the ink pack 201 is sandwiched, in a clinched manner, between the protuberances 208 and the recesses 208'. By sandwiching several locations on the peripheral edge of the ink pack 201 according to the method set forth, the ink pack 201 can be fixedly secured within the case.

In this embodiment, the ink pack 201 can be easily taken out from the case upon removal of the cover 203. As in the case of the embodiment shown in FIGS. 28A through 28C, recycling of an ink cartridge can be performed readily.

Figure 35:
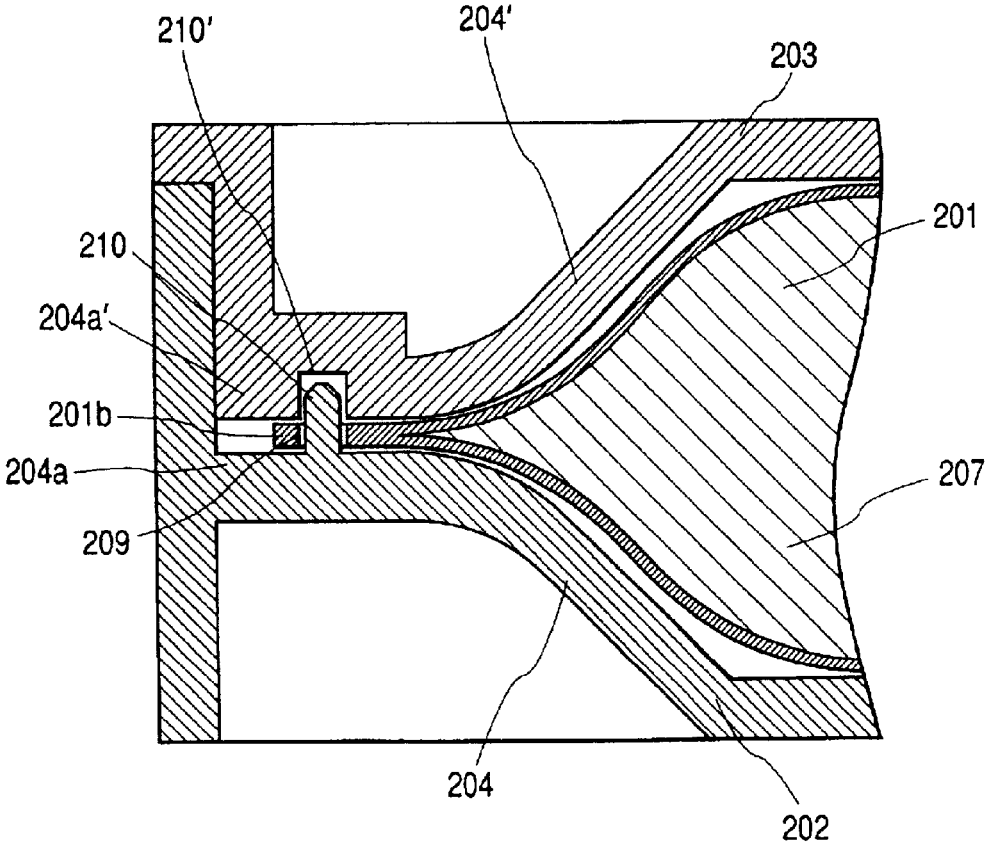
FIG. 35 is a cross-sectional view of another preferred example of the ink cartridge according to the present invention, showing a construction for fastening the periphery section of the ink pack.
Figure 36:
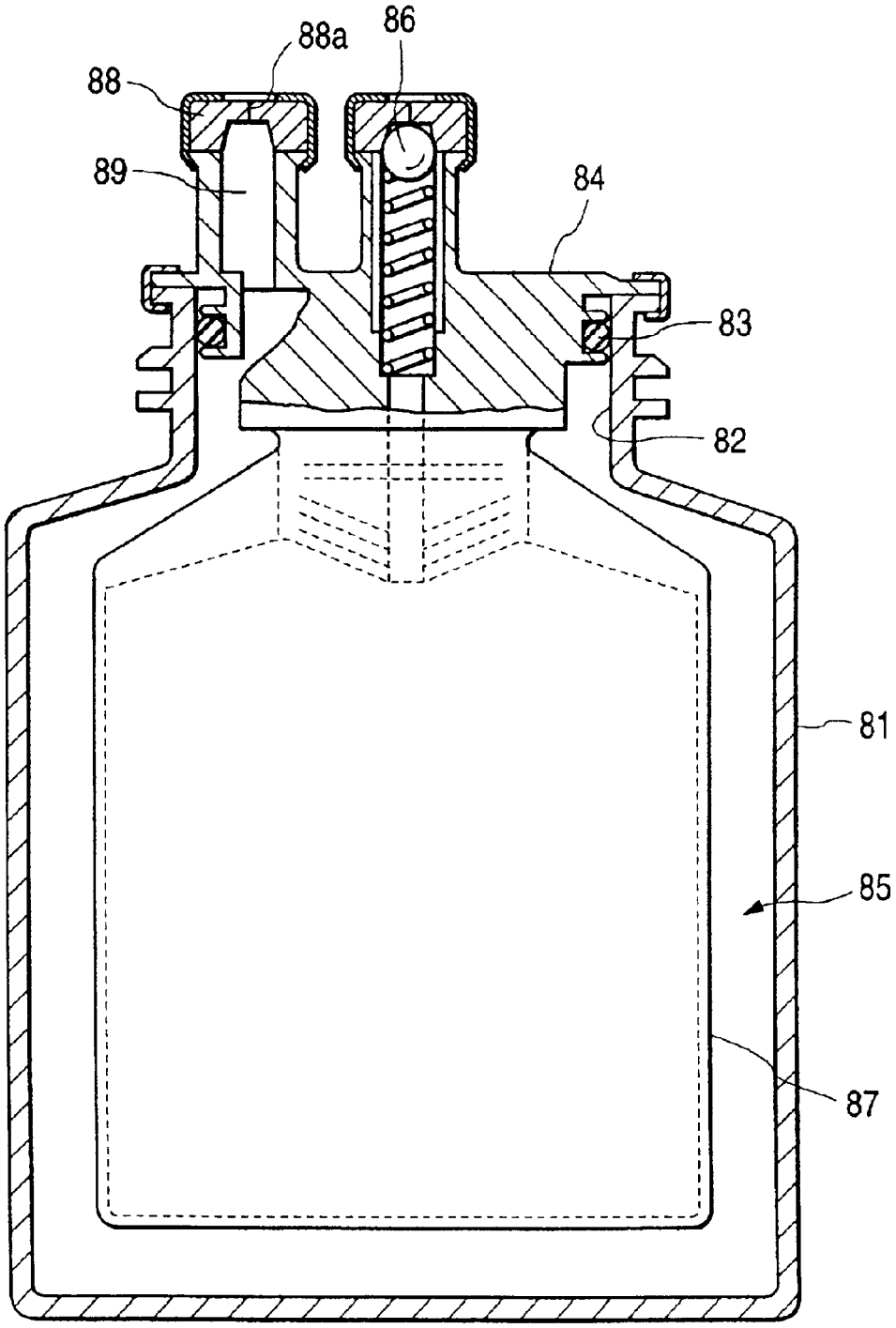
FIG. 36 is a cross-sectional view showing an example of a related-art ink cartridge.

FIG. 35 is a cross-sectional view showing a construction for sandwiching the peripheral edge of an ink pack according to yet another preferred embodiment. The through hole 209 is formed in the peripheral edge 201*b* of the ink pack 201. The raised sections 204 and 204' are formed such that the cross section of the lower case 202 and that of the cover 203 match the cross section of the pillow-shaped ink pack 201 filled with the ink 207. Moreover, the protrusion 210 to be inserted into the through hole 209 is formed on the end section 204, and the hole 210' is formed in the end section 204' so as to correspond to the protrusion 210. The set including the through hole 209, the protrusion 210, and the hole 210' is formed in each of several locations on the peripheral edge of the ink pack 201.

The ink pack 201 is housed in the case main body 202 such that the protrusions 210 are inserted into the corresponding through holes 209. As the cover 203 is placed on the case main body 202 from above, the ink pack 201 is positioned and fixed by the through holes 209 and the protrusions 210.

In the present embodiment, the ink pack 201 can be readily removed by taking off the cover 203. As in the case of the embodiment shown in FIGS. 28A through 28C, recycling of an ink cartridge can be readily performed.

As mentioned above, in a case where the construction of an ink cartridge of any of several embodiments is employed, deformation in an ink pack, which would otherwise be caused by vibration or physical shock, is regulated in all directions, thus preventing damage to and fracture of the ink pack.

Positioning of an ink pack is effected by the geometry of a case, thus diminishing variations in quality stemming from accuracy of assembly.

Since an ink pack does not need to be fixed through use of an adhesive, the number of parts is diminished, thereby resulting in an increase in the efficiency of assembly of an ink cartridge and reducing the costs of an ink cartridge. Since disassembly of the ink cartridge is easy, highly-reliable recycling of an ink cartridge can be achieved.

What is claimed is:

1. An ink cartridge for use with a recording apparatus, including an ink pack of flexible material storing ink therein, and a cartridge case which houses the ink pack and constitutes an outer shell, the ink cartridge comprising:

an ink pack press member which is housed in the cartridge case along with the ink pack, wherein said press member is separate from said cartridge case and is held by the cartridge case so that the consumption of ink pack does not cause movement of the press member.

2. The ink cartridge according to claim 1, wherein the ink pack is formed into a substantially rectangular shape and into a bag by sealing four sides of the ink pack; wherein the press member housed in the cartridge case along with the ink pack is formed into a frame shape having an window opening in a central portion thereof; and wherein the four sides of the ink pack are pressed by the frame-shaped press member.

3. The ink cartridge according to claim 2, wherein parts of the press member opposing the four sides of the ink pack are gradually reduced in thickness toward the window opening to define slope surfaces.

4. The ink cartridge according to claim 3, wherein the slope surfaces are curved.

5. The ink cartridge according to claim 1, wherein the press member is formed from resilient material.

6. The ink cartridge according to any one of claims 1 through 5, wherein the cartridge case is hermetically formed; and wherein, as pressurized air is introduced into the case when the ink cartridge is mounted to the recording apparatus, the ink pack is pressurized by air pressure.

7. The ink cartridge according to claim 6, wherein the cartridge case includes a first case and a second case; wherein after the ink pack and the press member are housed in the first case, an edge of an opening of the first case is sealed by a film member, thereby realizing a sealed state, and wherein the second case functions as a cover for preventing expansion of the film member when the film member receives the pressurized air.

8. The ink cartridge according to claim 7, wherein at least one lug-shaped member is formed on the second case; and wherein a tapered surface and an engagement step section are formed on the lug-shaped member such that, when the second case is attached to the first case, a flange section formed on the edge of the opening of the first case is relatively guided by and along the tapered surface to engage with the engagement step section.

9. The ink cartridge according to claim 1, wherein said press member is selected from a plurality of available press members having respective different of shapes.

10. The ink cartridge according to claim 1, wherein the cartridge case includes an upper case and a lower case, and the lower case has a concave recess portion on which the ink pack is placed.

11. The ink cartridge according to claim 10, wherein the concave recessed portion is defined by a plurality of ribs protruded from a bottom surface of the lower case.

12. The ink cartridge according to claim 10, wherein the ink pack press member is disposed between the upper case and the ink pack.

13. The ink cartridge according to claim 1, wherein an outer perimeter of the press member is arranged directly adjacent to an inner perimeter of the cartridge case.

14. The ink cartridge according to claim 1, wherein the press member is generally frame shaped, and comprises an inner perimeter and outer perimeter that are generally parallel to each other.

15. The ink cartridge according to claim 14, wherein the press member increases in thickness from the inner perimeter to the outer perimeter to create a tapered surface.

16. The ink cartridge according to claim 15, wherein the press member further comprises a constant thickness portion between the inner perimeter and the outer perimeter, adjacent to the outer perimeter.

17. The ink cartridge according to claim 15, wherein the tapered surface faces the ink pack.

18. The ink cartridge according to claim 1, wherein the press member is substantially rigid and the ink pack is pliable.

19. The ink cartridge according to claim 1, wherein the press member remains stationary relative to the cartridge case as the ink pack drains during operation.

20. The ink cartridge according to claim 1, wherein the position of the press member within the cartridge case is unaffected by the filling state of the ink pack.

21. The ink cartridge according to claim 1, wherein the press member is a substantially frame shaped structure arranged along the periphery of the ink pack.

22. The ink cartridge according to claim 21, wherein the press member has a substantially window shaped opening within the frame.

23. The ink cartridge according to claim 1, wherein the volume of the press member within the cartridge case limits an available volume for the ink pack to accommodate ink.

24. The ink cartridge according to claim 23, wherein various press members may be arranged within the cartridge case to modify the available volume.

25. The ink cartridge according to claim 1, wherein the cartridge case includes a case member and a lid member coupled to the case member, and the ink cartridge further comprises a film that is attached to an edge of an opening of the case member containing the ink pack and that is interposed between the ink pack and the lid member coupled to the case member.

26. An ink cartridge for use with a recording apparatus, including an ink pack of flexible material storing ink therein, and a cartridge case which houses the ink pack and constitutes an outer shell, the ink cartridge comprising:

an ink pack press member having a tapered surface which is gradually thicker toward a periphery of the press member and which presses a welded peripheral portion of the ink pack when the press member is housed on the cartridge case along with the ink pack.

27. The ink cartridge according to claim 26, wherein the tapered surface extends along four sides of the press member to press the welded peripheral portion extending along four sides of the ink pack.

28. The ink cartridge according to claim 26, wherein an outer perimeter of the press member is arranged directly adjacent to an inner perimeter of the cartridge case.

29. The ink cartridge according to claim 26, wherein the press member is generally frame shaped, and comprises an inner perimeter and outer perimeter that are generally parallel to each other.

30. The ink cartridge according to claim 29, wherein the press member increases in thickness from the inner perimeter to the outer perimeter to create a tapered surface.

31. The ink cartridge according to claim 30, wherein the tapered surface faces the ink pack.

32. The ink cartridge according to claim 29, wherein the press member further comprises a constant thickness portion between the inner perimeter and the outer perimeter, adjacent to the outer perimeter.

33. The ink cartridge according to claim 26, wherein the press member is substantially rigid and the ink pack is pliable.

34. The ink cartridge according to claim 26, wherein the press member is substantially rigid as compared to the ink pack.

35. The ink cartridge according to claim 26, wherein the press member remains stationary relative to the cartridge case as the ink pack drains during operation.

36. The ink cartridge according to claim 26, wherein the position of the press member within the cartridge case is unaffected by the filling state of the ink pack.

37. The ink cartridge according to claim 26, wherein the press member is a substantially frame shaped structure arranged along the periphery of the ink pack.

38. The ink cartridge according to claim 37, wherein the press member has a substantially window shaped opening within the frame.

39. The ink cartridge according to claim 26, wherein the volume of the press member within the cartridge case limits an available volume for the ink pack to accommodate ink.

40. The ink cartridge according to claim 39, wherein various press members may be arranged within the cartridge case to modify the available volume.

41. The ink according to claim 26, wherein the cartridge case includes a case member and a lid member coupled to the case member, and the ink cartridge further comprises a film that is attached to an edge of an opening of the case member containing the ink pack and that is interposed between the ink pack and the lid member coupled to the case member.

42. The ink cartridge according to claim 26, wherein said press member is held by the cartridge case so that the consumption of ink from the ink pack does not cause movement of the press member.

43. An ink cartridge for use with a recording apparatus, including an ink pack of flexible material storing ink therein, and a cartridge case which houses the ink pack and constitutes an outer shell, the ink cartridge comprising:

an ink pack press member which is housed in the cartridge case along with the ink pack and which adjusts the volume of ink to be filled into the ink pack in accordance with the volume of the press member, wherein said press member is separate from said cartridge case, wherein said press member is selected from a plurality of available press members having respective different shapes.

44. The ink cartridge according to claim 43, wherein the press member comprises a tapered surface that extends along four sides of the press member to press the welded peripheral portion extending along four sides of the ink pack.

45. The ink cartridge according to claim 43, wherein an outer perimeter of the press member is arranged directly adjacent to an inner perimeter of the cartridge case.

46. The ink cartridge according to claim 43, wherein the press member is generally frame shaped, and comprises and inner perimeter and outer perimeter that are generally parallel to each other.

47. The ink cartridge according to claim 46, wherein the press member increases in thickness from the inner perimeter to the outer perimeter to create a tapered surface.

48. The ink cartridge according to claim 47, wherein the tapered surface faces the ink pack.

49. The ink cartridge according to claim 43, wherein the press member is substantially rigid and the ink pack is pliable.

50. The ink cartridge according to claim 46, wherein the press member further comprises a constant thickness portion between the inner perimeter and the outer perimeter, adjacent to the outer perimeter.

51. The ink cartridge according to claim 43, wherein the press member is substantially rigid as compared to the ink pack.

52. The ink cartridge according to claim 43, wherein the press member remains stationary relative to the cartridge case as the ink pack drains during operation.

53. The ink cartridge according to claim 43, wherein the position of the press member within the cartridge case is unaffected by the filling state of the ink pack.

54. The ink cartridge according to claim 43, wherein the press member is a substantially frame shaped structure arranged along the periphery of the ink pack.

55. The ink cartridge according to claim 54, wherein the press member has a substantially window shaped opening within the frame.

56. The ink cartridge according to claim 43, wherein the volume of the press member within the cartridge case limits an available volume for the ink pack to accommodate ink.

57. The ink cartridge according to claim 56, wherein various press members may be arranged within the cartridge case to modify the available volume.

58. The ink cartridge according to claim 43, wherein the cartridge case includes a case member and a lid member coupled to the case member, and the ink cartridge further comprises a film that is attached to an edge of an opening of the case member containing the ink pack and that is interposed between the ink pack and the lid member coupled to the case member.

59. The ink cartridge according to claim 43, wherein said press member is held by the cartridge case so that the consumption of ink from the ink pack does not cause movement of the press member.

* * * * *